US009393560B2

(12) United States Patent
Ness et al.

(10) Patent No.: US 9,393,560 B2
(45) Date of Patent: Jul. 19, 2016

(54) DROPLET TRANSPORT SYSTEM FOR DETECTION

(75) Inventors: Kevin D. Ness, San Mateo, CA (US); Benjamin J. Hindson, Livermore, CA (US); Anthony J. Makarewicz, Jr., Livermore, CA (US); Amy L. Hiddessen, Dublin, CA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 128 days.

(21) Appl. No.: 13/341,688

(22) Filed: Dec. 30, 2011

(65) Prior Publication Data

US 2012/0190033 A1 Jul. 26, 2012

Related U.S. Application Data

(63) Continuation of application No. PCT/US2011/030097, filed on Mar. 25, 2011.

(60) Provisional application No. 61/341,065, filed on Mar. 25, 2010, provisional application No. 61/467,347, filed on Mar. 24, 2011.

(51) Int. Cl.
*B01L 3/02* (2006.01)

(52) U.S. Cl.
CPC ..... *B01L 3/021* (2013.01); *B01L 2200/0673* (2013.01); *B01L 2400/0478* (2013.01); *B01L 2400/0622* (2013.01)

(58) Field of Classification Search
None
See application file for complete search history.

(56) References Cited

U.S. PATENT DOCUMENTS

| | | | |
|---|---|---|---|
| 3,575,220 | A | 4/1971 | Davis et al. |
| 4,051,025 | A | 9/1977 | Ito |
| 4,121,466 | A | 10/1978 | Reichler et al. |
| 4,201,691 | A | 5/1980 | Asher et al. |
| 4,283,262 | A | 8/1981 | Cormier et al. |
| 4,348,111 | A | 9/1982 | Goulas et al. |
| 4,636,075 | A | 1/1987 | Knollenberg |

(Continued)

FOREIGN PATENT DOCUMENTS

| | | |
|---|---|---|
| EP | 0638809 A2 | 2/1995 |
| EP | 1 522 582 A2 | 4/2005 |

(Continued)

OTHER PUBLICATIONS

Shah et al. Designer emulsions using microfluidics. Materials Today 2008;11(4):18-27.*

(Continued)

*Primary Examiner* — Samuel Woolwine
(74) *Attorney, Agent, or Firm* — Kolisch Hartwell, P.C.

(57) ABSTRACT

Method of transporting droplets for detection. An emulsion disposed in a container and including droplets may be provided. Contact may be created between a tip and the emulsion. The tip may be connected to an examination region and may include an outer tube and an inner tube. The outer tube may form a first open end and surround an enclosed portion of the inner tube. The inner tube may extend out of the first open end to create a projecting portion forming a second open end below the first open end. Droplets of the emulsion may be loaded into the inner tube via the second open end. Loaded droplets may be moved from the inner tube to the examination region. Fluid may be dispensed onto the projecting portion of the inner tube from the first open end formed by the outer tube.

17 Claims, 9 Drawing Sheets

(56) References Cited

U.S. PATENT DOCUMENTS 4,948,961 A 8/1990 Hillman et al.
5,055,390 A 10/1991 Weaver et al.
5,176,203 A 1/1993 Larzul
5,225,332 A 7/1993 Weaver et al.
5,270,183 A 12/1993 Corbett et al.
5,314,809 A 5/1994 Erlich et al.
5,344,930 A 9/1994 Riess et al.
5,408,891 A * 4/1995 Barber ..... G01N 35/1004 73/864.22
5,422,277 A 6/1995 Connelly et al.
5,538,667 A 7/1996 Hill et al.
5,555,191 A 9/1996 Hripcsak
5,585,069 A 12/1996 Zanzucchi et al.
5,587,128 A 12/1996 Wilding et al.
5,602,756 A 2/1997 Atwood et al.
5,720,923 A 2/1998 Haff et al.
5,736,314 A 4/1998 Hayes et al.
5,779,977 A 7/1998 Haff et al.
5,827,480 A 10/1998 Haff et al.
5,856,174 A 1/1999 Lipshutz et al.
5,912,945 A 6/1999 Da Silva et al.
5,928,907 A 7/1999 Woudenberg et al.
5,945,334 A 8/1999 Besemer et al.
5,972,716 A 10/1999 Ragusa et al.
5,980,936 A 11/1999 Krafft et al.
5,994,056 A 11/1999 Higuchi
6,033,880 A 3/2000 Haff et al.
6,042,709 A 3/2000 Parce et al.
6,057,149 A 5/2000 Burns et al.
6,126,899 A 10/2000 Woudenberg et al.
6,130,098 A 10/2000 Handique et al.
6,143,496 A 11/2000 Brown et al.
6,146,103 A 11/2000 Lee et al.
6,171,785 B1 1/2001 Higuchi
6,175,669 B1 1/2001 Colston et al.
6,176,609 B1 1/2001 Cleveland et al.
6,177,479 B1 1/2001 Nakajima et al.
6,210,879 B1 4/2001 Meloni et al.
6,258,569 B1 7/2001 Livak et al.
6,281,254 B1 8/2001 Nakajima et al.
6,303,343 B1 10/2001 Kopf-Sill
6,357,907 B1 3/2002 Cleveland et al.
6,384,915 B1 5/2002 Everett et al.
6,391,559 B1 5/2002 Brown et al.
6,413,780 B1 * 7/2002 Bach et al. ..... 436/48
6,440,706 B1 8/2002 Vogelstein et al.
6,466,713 B2 10/2002 Everett et al.
6,488,895 B1 12/2002 Kennedy
6,489,103 B1 12/2002 Griffiths et al.
6,494,104 B2 12/2002 Kawakita et al.
6,509,085 B1 1/2003 Kennedy
6,521,427 B1 2/2003 Evans
6,524,456 B1 2/2003 Ramsey et al.
6,540,895 B1 4/2003 Spence et al.
6,551,841 B1 4/2003 Wilding et al.
6,558,916 B2 5/2003 Veerapandian et al.
6,575,188 B2 6/2003 Parunak
6,602,472 B1 8/2003 Zimmermann et al.
6,620,625 B2 9/2003 Wolk et al.
6,637,463 B1 10/2003 Lei et al.
6,638,749 B1 10/2003 Beckman et al.
6,660,367 B1 12/2003 Yang et al.
6,663,619 B2 12/2003 Odrich et al.
6,664,044 B1 12/2003 Sato
6,670,153 B2 12/2003 Stern
6,753,147 B2 6/2004 Vogelstein et al.
6,767,706 B2 7/2004 Quake et al.
6,773,566 B2 8/2004 Shenderov
6,808,882 B2 10/2004 Griffiths et al.
6,814,934 B1 11/2004 Higuchi
6,833,242 B2 12/2004 Quake et al.
6,900,021 B1 5/2005 Harrison et al.
6,905,885 B2 6/2005 Colston et al.
6,949,176 B2 9/2005 Vacca et al.
6,960,437 B2 11/2005 Enzelberger et al.
6,964,846 B1 11/2005 Shuber
7,010,391 B2 3/2006 Handique et al.
7,041,481 B2 5/2006 Anderson et al.
7,052,244 B2 5/2006 Fouillet et al.
7,081,336 B2 7/2006 Bao et al.
7,091,048 B2 8/2006 Parce et al.
7,094,379 B2 8/2006 Fouillet et al.
7,118,910 B2 10/2006 Unger et al.
7,129,091 B2 10/2006 Ismagilov et al.
7,138,233 B2 11/2006 Griffiths et al.
7,141,537 B2 11/2006 Audenaert et al.
7,192,557 B2 3/2007 Wu et al.
7,198,897 B2 4/2007 Wangh et al.
7,238,268 B2 7/2007 Ramsey et al.
7,244,567 B2 7/2007 Chen et al.
7,252,943 B2 8/2007 Griffiths et al.
7,268,167 B2 9/2007 Higuchi et al.
7,268,179 B2 9/2007 Brown
7,270,786 B2 9/2007 Parunak et al.
7,279,146 B2 10/2007 Nassef et al.
7,294,468 B2 11/2007 Bell et al.
7,294,503 B2 11/2007 Quake et al.
7,306,929 B2 12/2007 Ignatov et al.
7,312,085 B2 12/2007 Chou et al.
7,323,305 B2 1/2008 Leamon et al.
7,368,233 B2 5/2008 Shuber et al.
7,375,140 B2 5/2008 Higuchi et al.
7,423,751 B2 9/2008 Hairston et al.
7,429,467 B2 9/2008 Holliger et al.
7,567,596 B2 7/2009 Dantus et al.
7,579,172 B2 8/2009 Cho et al.
7,595,195 B2 9/2009 Lee et al.
7,622,280 B2 11/2009 Holliger et al.
7,629,123 B2 12/2009 Millonig et al.
7,776,927 B2 8/2010 Chu et al.
7,807,920 B2 10/2010 Linke et al.
7,842,457 B2 11/2010 Berka et al.
8,399,198 B2 3/2013 Hiddessen et al.
2001/0046701 A1 11/2001 Schulte et al.
2002/0021866 A1 2/2002 Everett et al.
2002/0022261 A1 2/2002 Anderson et al.
2002/0060156 A1 5/2002 Mathies et al.
2002/0068357 A1 6/2002 Mathies et al.
2002/0093655 A1 7/2002 Everett et al.
2002/0141903 A1 10/2002 Parunak et al.
2002/0142483 A1 10/2002 Yao et al.
2002/0151040 A1 10/2002 O'Keefe et al.
2002/0164820 A1 11/2002 Brown
2002/0195586 A1 12/2002 Auslander et al.
2003/0001121 A1 1/2003 Hochstein
2003/0003054 A1 1/2003 McDonald et al.
2003/0003441 A1 1/2003 Colston et al.
2003/0008308 A1 1/2003 Enzelberger et al.
2003/0027150 A1 2/2003 Katz
2003/0027244 A1 2/2003 Colston et al.
2003/0027352 A1 2/2003 Hooper et al.
2003/0032172 A1 2/2003 Colston, Jr. et al.
2003/0049659 A1 3/2003 Lapidus et al.
2003/0087300 A1 5/2003 Knapp et al.
2003/0170698 A1 9/2003 Gascoyne et al.
2003/0180765 A1 9/2003 Traverso et al.
2003/0204130 A1 10/2003 Colston, Jr. et al.
2004/0007463 A1 1/2004 Ramsey et al.
2004/0038385 A1 2/2004 Langlois et al.
2004/0067493 A1 4/2004 Matsuzaki et al.
2004/0068019 A1 4/2004 Higuchi et al.
2004/0074849 A1 4/2004 Brown et al.
2004/0171055 A1 9/2004 Brown
2004/0180346 A1 9/2004 Anderson et al.
2004/0208792 A1 10/2004 Linton et al.
2005/0036920 A1 2/2005 Gilbert
2005/0042639 A1 2/2005 Knapp et al.
2005/0064460 A1 3/2005 Holliger et al.
2005/0079510 A1 4/2005 Berka et al.
2005/0112541 A1 5/2005 Durack et al.
2005/0172476 A1 8/2005 Stone et al.
2005/0202429 A1 9/2005 Trau et al.
2005/0221279 A1 10/2005 Carter et al.
2005/0221373 A1 10/2005 Enzelberger et al.

(56) References Cited

U.S. PATENT DOCUMENTS

2005/0227264 A1 10/2005 Nobile et al.
2005/0239192 A1 10/2005 Nasarabadi et al.
2005/0277125 A1 12/2005 Benn et al.
2005/0282206 A1 12/2005 Michael Corbett et al.
2006/0014187 A1 1/2006 Li et al.
2006/0057599 A1 3/2006 Dzenitis et al.
2006/0077755 A1 4/2006 Higuchi et al.
2006/0079583 A1 4/2006 Higuchi et al.
2006/0079584 A1 4/2006 Higuchi et al.
2006/0079585 A1 4/2006 Higuchi et al.
2006/0094108 A1 5/2006 Yoder et al.
2006/0106208 A1 5/2006 Nochumson et al.
2006/0188463 A1 8/2006 Kim et al.
2007/0003442 A1 1/2007 Link et al.
2007/0010974 A1 1/2007 Nicoli et al.
2007/0048756 A1 3/2007 Mei et al.
2007/0109542 A1 5/2007 Tracy et al.
2007/0166200 A1 7/2007 Zhou et al.
2007/0195127 A1 8/2007 Ahn et al.
2007/0196397 A1 8/2007 Torii et al.
2007/0202525 A1 8/2007 Quake et al.
2007/0231393 A1 10/2007 Ritter et al.
2007/0242111 A1 10/2007 Pamula et al.
2007/0248956 A1 10/2007 Buxbaum et al.
2007/0258083 A1 11/2007 Heppell et al.
2007/0275415 A1 11/2007 Srinivasan et al.
2008/0003142 A1* 1/2008 Link et al. ..... 422/82.08
2008/0014589 A1 1/2008 Link et al.
2008/0038810 A1* 2/2008 Pollack et al. ..... 435/283.1
2008/0070862 A1 3/2008 Laster et al.
2008/0090244 A1 4/2008 Knapp et al.
2008/0138815 A1 6/2008 Brown et al.
2008/0145923 A1 6/2008 Hahn et al.
2008/0153091 A1 6/2008 Brown et al.
2008/0160525 A1 7/2008 Brown et al.
2008/0161420 A1 7/2008 Shuber
2008/0166793 A1 7/2008 Beer et al.
2008/0169184 A1 7/2008 Brown et al.
2008/0169195 A1 7/2008 Jones et al.
2008/0171324 A1 7/2008 Brown et al.
2008/0171325 A1 7/2008 Brown et al.
2008/0171326 A1 7/2008 Brown et al.
2008/0171327 A1 7/2008 Brown et al.
2008/0171380 A1 7/2008 Brown et al.
2008/0171382 A1 7/2008 Brown et al.
2008/0213766 A1 9/2008 Brown et al.
2008/0214407 A1 9/2008 Remacle et al.
2008/0262384 A1 10/2008 Wiederkehr et al.
2008/0268436 A1 10/2008 Duan et al.
2008/0274455 A1 11/2008 Puskas et al.
2008/0280331 A1 11/2008 Davies et al.
2008/0280865 A1 11/2008 Tobita
2008/0280955 A1 11/2008 McCamish
2008/0314761 A1 12/2008 Herminghaus et al.
2009/0012187 A1 1/2009 Chu et al.
2009/0026082 A1 1/2009 Rothberg et al.
2009/0029867 A1 1/2009 Reed et al.
2009/0035770 A1* 2/2009 Mathies et al. ..... 435/6
2009/0035838 A1 2/2009 Quake et al.
2009/0061428 A1 3/2009 McBride et al.
2009/0068170 A1* 3/2009 Weitz et al. ..... 424/130.1
2009/0069194 A1 3/2009 Ramakrishnan
2009/0098044 A1 4/2009 Kong et al.
2009/0114043 A1 5/2009 Cox
2009/0131543 A1 5/2009 Weitz et al.
2009/0162929 A1 6/2009 Ikeda
2009/0176271 A1 7/2009 Durack et al.
2009/0203063 A1 8/2009 Wheeler et al.
2009/0217742 A1 9/2009 Chiu et al.
2009/0220434 A1 9/2009 Sharma
2009/0235990 A1 9/2009 Beer
2009/0239308 A1 9/2009 Dube et al.
2009/0291435 A1 11/2009 Unger et al.
2009/0311713 A1 12/2009 Pollack et al.
2009/0325184 A1 12/2009 Woudenberg et al.
2009/0325234 A1 12/2009 Gregg et al.
2009/0325236 A1 12/2009 Griffiths et al.
2010/0009360 A1 1/2010 Rosell Costa et al.
2010/0020565 A1 1/2010 Seward
2010/0022414 A1 1/2010 Link et al.
2010/0041046 A1 2/2010 Chiu et al.
2010/0047808 A1 2/2010 Reed et al.
2010/0069250 A1 3/2010 White, III et al.
2010/0069263 A1 3/2010 Shendure et al.
2010/0092973 A1 4/2010 Davies et al.
2010/0137163 A1 6/2010 Link et al.
2010/0173394 A1 7/2010 Colston, Jr. et al.
2010/0248385 A1 9/2010 Tan et al.
2010/0261229 A1 10/2010 Lau et al.
2010/0304446 A1 12/2010 Davies et al.
2010/0304978 A1 12/2010 Deng et al.
2011/0000560 A1 1/2011 Miller et al.
2011/0027394 A1 2/2011 McClements et al.
2011/0053798 A1 3/2011 Hindson et al.
2011/0070589 A1 3/2011 Belgrader et al.
2011/0086780 A1 4/2011 Colston, Jr. et al.
2011/0092373 A1 4/2011 Colston, Jr. et al.
2011/0092376 A1 4/2011 Colston, Jr. et al.
2011/0092392 A1 4/2011 Colston, Jr. et al.
2011/0118151 A1 5/2011 Eshoo et al.
2011/0160078 A1 6/2011 Fodor et al.
2011/0177563 A1 7/2011 Hahn et al.
2011/0183330 A1 7/2011 Lo et al.
2011/0212516 A1 9/2011 Ness et al.
2011/0217712 A1 9/2011 Hiddessen et al.
2011/0217736 A1 9/2011 Hindson
2011/0218123 A1 9/2011 Weitz et al.
2011/0244455 A1 10/2011 Larson et al.
2011/0250597 A1 10/2011 Larson et al.
2011/0311978 A1 12/2011 Makarewicz, Jr. et al.
2012/0021423 A1 1/2012 Colston, Jr. et al.
2012/0028311 A1 2/2012 Colston, Jr. et al.
2012/0122714 A1 5/2012 Samuels et al.
2012/0152369 A1 6/2012 Hiddessen et al.
2012/0171683 A1 7/2012 Ness et al.
2012/0190032 A1 7/2012 Ness et al.
2012/0194805 A1 8/2012 Ness et al.
2012/0208241 A1 8/2012 Link
2012/0219947 A1 8/2012 Yurkovetsky et al.
2012/0220494 A1 8/2012 Samuels et al.
2012/0264646 A1 10/2012 Link et al.
2012/0302448 A1 11/2012 Hutchison et al.
2012/0309002 A1 12/2012 Link
2012/0329664 A1 12/2012 Saxonov et al.
2013/0017551 A1 1/2013 Dube
2013/0040841 A1 2/2013 Saxonov et al.
2013/0045875 A1 2/2013 Saxonov et al.
2013/0059754 A1 3/2013 Tzonev
2013/0064776 A1 3/2013 El Harrak et al.
2013/0084572 A1 4/2013 Hindson et al.
2013/0099018 A1 4/2013 Miller et al.
2013/0109575 A1 5/2013 Kleinschmidt et al.

FOREIGN PATENT DOCUMENTS

EP 1 522 582 B1 4/2007
GB 1 503 163 3/1978
GB 2 097 692 11/1982
JP 0295433 4/1990
JP 2006326419 A 12/2006
JP 2009031174 A 2/2009
WO 82/02562 8/1982
WO 84/02000 5/1984
WO 92/01812 2/1992
WO 94/05414 3/1994
WO 96/12194 4/1996
WO 98/00231 1/1998
WO 98/16313 4/1998
WO 98/44151 10/1998
WO 98/44152 10/1998
WO 98/47003 10/1998
WO 01/07159 2/2001
WO 01/12327 2/2001
WO 02/23163 3/2002

(56) References Cited

FOREIGN PATENT DOCUMENTS

| | | | |
|---|---|---|---|
| WO | 02/060584 | | 8/2002 |
| WO | 02/068104 | | 9/2002 |
| WO | 02/081490 | | 10/2002 |
| WO | 02/081729 | | 10/2002 |
| WO | 03/016558 | | 2/2003 |
| WO | 03/042410 | | 5/2003 |
| WO | 03/072258 | | 9/2003 |
| WO | 2004/040001 | | 5/2004 |
| WO | 2004/102204 | A1 | 11/2004 |
| WO | 2005/007812 | | 1/2005 |
| WO | 2005/010145 | | 2/2005 |
| WO | 2005/021151 | | 3/2005 |
| WO | 2005/023091 | | 3/2005 |
| WO | 2005/055807 | | 6/2005 |
| WO | 2005/073410 | | 8/2005 |
| WO | 2005/075683 | | 8/2005 |
| WO | 2006/023719 | | 3/2006 |
| WO | 2006/027757 | | 3/2006 |
| WO | 2006/038035 | | 4/2006 |
| WO | 2006/086777 | | 8/2006 |
| WO | 2006/095981 | | 9/2006 |
| WO | 2007/091228 | | 8/2007 |
| WO | 2007/091230 | | 8/2007 |
| WO | 2007/092473 | | 8/2007 |
| WO | 2007/133710 | | 11/2007 |
| WO | 2008/021123 | | 2/2008 |
| WO | 2008/024114 | | 2/2008 |
| WO | 2008/063227 | | 5/2008 |
| WO | 2008/070074 | | 6/2008 |
| WO | 2008/070862 | | 6/2008 |
| WO | 2008/109176 | | 9/2008 |
| WO | 2008/109878 | | 9/2008 |
| WO | 2008/112177 | | 9/2008 |
| WO | 2009/002920 | | 12/2008 |
| WO | 2009/015863 | | 2/2009 |
| WO | 2009/049889 | | 4/2009 |
| WO | 2009/085246 | | 7/2009 |
| WO | 2010/001419 | | 1/2010 |
| WO | 2010/018465 | | 2/2010 |
| WO | 2011/034621 | | 3/2011 |
| WO | 2011/079176 | | 6/2011 |

OTHER PUBLICATIONS

Beer et al., Monodisperse droplet generation and rapid trapping for single molecule detection and reaction kinetics measurement, Lab Chip, vol. 9 (2009) 841-844.

Beer et al., On-Chip, Real-Time, Single-Copy Polymerase Chain Reaction in Picoliter Droplets, Analytical Chemistry, vol. 79, No. 22 (2007) 8471-8475.

Mazutis et al., Droplet-Based Microfluidic Systems for High-Throughput Single DNA Molecule Isothermal Amplification and Analysis, Analytical Chemistry, vol. 81, No. 12 (2009) 4813-4821.

Young, Lee W., Authorized officer, International Searching Authority, International Search Report, PCT Application No. PCT/US 201130097; search completion: May 16, 2011; mail date: Jun. 7, 2011.

Young, Lee W., Authorized officer, International Searching Authority, Written Opinion of the International Searching Authority, PCT Application No. PCT/US 201130097; opinion completion: May 16, 2011; mail date: Jun. 7, 2011.

J. Smid-Korbar et al., "Efficiency and usability of silicone surfactants in emulsions," International Journal of Cosmetic Science 12, pp. 135-139, (1990), presented at the 15$^{th}$ IFSCC International Congress, Sep. 26-29, 1988, London.

A. Chittofrati et al., "Perfluoropolyether microemulsions," Progress in Colloid & Polymer Science 79, pp. 218-225, (1989).

Steven A. Snow, "Synthesis and Characterization of Zwitterionic Silicone Sulfobetaine Surfactants," Langmuir, vol. 6, No. 2, American Chemical Society, pp. 385-391, (1990).

Polydimethylsiloxane, 5 pgs., published in FNP 52 (1992).

Russell Higuchi et al., "Kinetic PCR Analysis: Real-time Monitoring of DNA Amplification Reactions," Bio/Technology vol. II, pp. 1026-1030, Sep. 11, 1993.

D. A. Newman et al., "Phase Behavior of Fluoroether-Functional Amphiphiles in Supercritical Carbon Dioxide," The Journal of Supercritical Fluids, vol. 6, No. 4, pp. 205-210, (1993).

Y. Sela et al., "Newly designed polysiloxane-graft-poly (oxyethylene) copolymeric surfactants: preparation, surface activity and emulsification properties," Colloid & Polymer Science 272, pp. 684-691, (1994).

M. Gasperlin et al., "The structure elucidation of semisolid w/o emulsion systems containing silicone surfactant," International Journal of Pharmaceutics 107, pp. 51-56, (1994).

Mieczyslaw A. Piatyszek et al., "Detection of telomerase activity in human cells and tumors by a telomeric repeat amplification protocol (TRAP)," Methods in Cell Science 17, pp. 1-15, (1995).

Anthony P. Shuber et al., "A Simplified Procedure for Developing Multiplex PCRs," Genome Research, published by Cold Spring Harbor Laboratory Press, pp. 488-493, (1995).

A. V. Yazdi et al., "Highly Carbon Dioxide Soluble Surfactants, Dispersants and Chelating Agents," Fluid Phase Equilibria, vol. 117, pp. 297-303, (1996).

Ariel A. Avilion et al., "Human Telomerase RNA and Telomerase Activity in Immortal Cell Lines and Tumor Tissues," Cancer Research 56, pp. 645-650, Feb. 1, 1996.

Shuming Nie et al., "Optical Detection of Single Molecules," Annu. Rev. Biophys. BiomoL Struct. vol. 26, pp. 567-596, (1997).

Edith J. Singley et al., "Phase behavior and emulsion formation of novel fluoroether amphiphiles in carbon dioxide," Fluid Phase Equilibria 128, pp. 199-219, (1997).

Olga Kalinina et al., "Nanoliter scale PCR with TaqMan Detection," Nucleic Acids Research, vol. 25, No. 10 pp. 1999-2004, (1997).

Zhen Guo et al , "Enhanced discrimination of single nucleotide polymorphisms by artificial mismatch hybridization," Nature Biotechnology vol. 15, pp. 331-335, Apr. 1997.

E. G. Ghenciu et al., "Affinity Extraction into Carbon Dioxide. 1. Extraction of Avidin Using a Biotin-Functional Fluoroether Surfactant," Ind. Eng. Chem. Res. vol. 36, No. 12, pp. 5366-5370, Dec. 1, 1997.

Paschalis Alexandridis, Structural Polymorphism of Poly(ethylene oxide)-Poly(propylene oxide) Block Copolymers in Nonaqueous Polar Solvents, Macromolecules, vol. 31, No. 20, pp. 6935-6942, Sep. 12, 1998.

Sandro R. P. Da Rocha et al., "Effect of Surfactants on the Interfacial Tension and Emulsion Formation between Water and Carbon Dioxide," Langmuir, vol. 15, No. 2, pp. 419-428, (1999), published on web Dec. 29, 1998.

Bert Vogelstein et al., "Digital PCR," Proc. Natl. Acad. Sci. USA, vol. 96, pp. 9236-9241, Aug. 1999.

Anthony J. O'Lenick, Jr., "Silicone Emulsions and Surfactants," Journal of Surfactants and Detergents, vol. 3, No. 3, Jul. 2000.

N. Garti et al., "Water Solubilization in Nonionic Microemulsions Stabilized by Grafted Siliconic Emulsifiers," Journal of Colloid and Interface Science vol. 233, pp. 286-294, (2001).

Shinji Katsura et al., "Indirect micromanipulation of single molecules in water-in-oil emulsion," Electrophoresis, vol. 22, pp. 289-293, (2001).

Hironobu Kunieda et al., "Effect of Hydrophilic- and Hydrophobic-Chain Lengths on the Phase Behavior of A-B-type Silicone Surfactants in Water," J. Phys. Chem. B, vol. 105, No. 23, pp. 5419-5426, (2001).

Hidenori Nagai et al., "Development of A Microchamber Array for Picoliter PCR," Analytical Chemistry, vol. 73, No. 5, pp. 1043-1047, Mar. 1, 2001.

Christopher B. Price, "Regular Review Point of Care Testing," BMJ, vol. 322, May 26, 2001; pp. 1285-1288.

3M Specialty Materials, "3M Fluorinert Electronic Liquid FC-3283," product information guide, issued Aug. 2001.

Ivonne Schneegaβ et al., "Miniaturized flow-through PCR with different template types in a silicon chip thermocycler," Lab on a Chip, vol. 1, pp. 42-49 (2001).

Randal M. Hill, "Silicone surfactants—new developments," Current Opinion in Colloid & Interface Science 7, pp. 255-261, (2002).

Richard M. Cawthon, "Telomere measurement by quantitative PCR," Nucleic Acids Research, vol. 30, No. 10, pp. 1-6, (2002).

(56) References Cited

OTHER PUBLICATIONS

Anfeng Wang et al., "Direct Force Measurement of Silicone- and Hydrocarbon-Based ABA Triblock Surfactants in Alcoholic Media by Atomic Force Mircroscopy," Journal of Colloid and Interface Science 256, pp. 331-340 (2002).
Shelley L. Anna et al., "Formation of dispersions using "flow focusing" in microchannels," Applied Physics Letters, vol. 82, No. 3, Jan. 20, 2003.
Goldschmidt GMBH, "Abil® EM 90 Emulsifier for the formulation of cosmetic W/O creams and lotions," degussa. creating essentials brochure, pp. 1-7, May 2003.
Purnendu K. Dasgupta et al., "Light emitting diode-based detectors Absorbance, fluorescence and spectroelectrochemical measurements in a planar flow-through cell," Analytica Chimica Acta 500, pp. 337-364, (2003).
R. G. Rutledge et al., "Mathematics of quantitative kinetic PCR and the application of standard curves," Nucleic Acids Research, vol. 31, No. 16, pp. 1-6, (2003).
Chunming Ding et al., "Direct molecular haplotyping of long-range genomic DNA with M1-PCR," PNAS, vol. 100, No. 13, pp. 7449-7453, Jun. 24, 2003.
Devin Dressman et al., "Transforming single DNA molecules into fluorescent magnetic particles for detection and enumeration of genetic variations," PNAS, vol. 100, No. 15, Jul. 22, 2003, pp. 8817-8822.
Ulf Landegren et al., "Padlock and proximity probes for in situ and array-based analyses: tools for the post-genomic era," Comp. Funct. Genom, vol. 4, pp. 525-530, (2003).
Gudrun Pohl et al., "Principle and applications of digital PCR" review, www.future-drugs.com, Expert Rev. Mol. Diagn. 4(1), pp. 41-47, (2004).
Groff M. Schroeder et al., "Introduction to Flow Cytometry" version 5.1, 182 pgs. (2004).
Stéphane Swillens et al., "Instant evaluation of the absolute initial number of cDNA copies from a single real-time PCR curve," Nucleic Acids Research, vol. 32, No. 6, pp. 1-6, (2004).
Mats Gullberg et al., "Cytokine detection by antibody-based proximity ligation," PNAS, vol. 101, No. 22, pp. 8420-8424, Jun. 1, 2004.
Tianhao Zhang et al., "Behavioral Modeling and Performance Evaluation of Microelectrofluidics-Based PCR Systems Using SystemC," IEEE Transactions on Computer-Aided Design of Integrated Circuits and Systems, vol. 23, No. 6, pp. 843-858, Jun. 2004.
R. G. Rutledge, "Sigmoidal curve-fitting redefines quantitative real-time PCR with the prospective of developing automated high-throughput applications," Nucleic Acids Research. vol. 32, No. 22, pp. 1-8, (2004).
L. Spencer Roach et al., "Controlling Nonspecific Protein Absorption in a Plug-Based Microfluidic System by Controlling Interfacial Chemistry Using Fluorous-Phase Surfactants," Analytical Chemistry vol. 77, No. 3, pp. 785-796, Feb. 1, 2005.
Kevin D. Dorfman et al., "Contamination-Free Continuous Flow Microfluidic Polymerase Chain Reaction for Quantitative and Clinical Applications," Analytical Chemistry vol. 77, No. 11, pp. 3700-3704, Jun. 1, 2005.
James G. Wetmur et al., "Molecular haplotyping by linking emulsion PCR: analysis of paraoxonase 1 haplotypes and phenotypes," Nucleic Acids Research, vol. 33, No. 8, pp. 2615-2619, (2005).
Piotr Garstecki et al., "Mechanism for Flow-Rate Controlled Breakup in Confined Geometries: A Route to Monodisperse Emulsions," Physical Review Letters, 164501, pp. 164501-1-164501-4, Apr. 29, 2005.
Anna Musyanovych et al., "Miniemulsion Droplets as Single Molecule Nanoreactors for Polymerase Chain Reaction," Biomacromolecules, vol. 6, No. 4, pp. 1824-1828, (2005).
Max Chabert et al., "Droplet fusion by alternating current (AC) field electrocoalescence in microchannels," Electrophoresis, vol. 26, pp. 3706-3715, (2005).
Takaaki Kojima et al., "PCR amplification from single DNA molecules on magnetic beads in emulsion: application for high-throughput screening of transcription factor targets," Nucleic Acids Research, vol. 33, No. 17, pp. 1-9, (2005).
Marcel Margulies et al., "Genome sequencing in microfabricated high-density picolitre reactors," Nature, vol. 437, 51 pgs., Sep. 15, 2005.
Kristofer J. Thurecht et al., "Investigation of spontaneous microemulsion formation in supercritical carbon dioxide using high-pressure NMR," Journal of Supercritical Fluids, vol. 38, pp. 111-118, (2006).
Toshko Zhelev et al., "Heat Integration in Micro-Fluidic Devices," 16$^{th}$ European Symposium on Computer Aided Process Engineering and 9$^{th}$ International Symposium on Process Systems Engineering, pp. 1863-1868 published by Elsevier B.V. (2006).
Piotr Garstecki et al., "Formation of droplets and bubbles in a microfluidic T-junction—scaling and mechanism of break-up," Lab on a Chip, vol. 6, pp. 437-446, (2006).
Darren R. Link et al., "Electric Control of Droplets in Microfluidic Devices," Angewandte Chemie Int. Ed., vol. 45, pp. 2556-2560, (2006).
Peter Fielden et al., "Micro-Droplet Technology for High Throughout Systems and Methods," 1 pg., Mar. 8, 2006.
David Emerson et al., "Microfluidic Modelling Activities at C3M," Centre for Microfluidics & Microsystems Modelling, Daresbury Laboratory, pp. 1-26, May 15, 2006.
Richard Williams et al., "Amplification of complex gene libraries by emulsion PCR," Nature Methods, vol. 3, No. 7, pp. 545-550, Jul. 2006.
John H. Leamon et al., "Overview: methods and applications for droplet compartmentalization of biology," Nature Methods, vol. 3, No. 7, pp. 541-543, Jul. 2006.
Andrew D. Griffiths et al., "Miniaturising the laboratory in emulsion droplets," TRENDS in Biotechnology, vol. 24, No. 9, pp. 395-402, Jul. 14, 2006.
Jian-Bing Fan et al., "Highly parallel genomic assays," Nature Reviews/Genetics, vol. 7, pp. 632-644, Aug. 2006.
Jonas Jarvius et al., "Digital quantification using amplified single-molecule detection," Nature Methods, vol. 3, No. 9, pp. 15 pgs, Sep. 2006.
Kan Liu et al., "Droplet-based synthetic method using microflow focusing and droplet fusion," Microfluid Nanfluid, vol. 3, pp. 239-243, (2007), published online Sep. 22, 2006.
Dimitris Glotsos et al., "Robust Estimation of Bioaffinity Assay Fluorescence Signals," IEEE Transactions on Information Technology in Biomedicine, vol. 10, No. 4, pp. 733-739, Oct. 2006.
Kristofer J. Thurecht et al., "Kinetics of Enzymatic Ring-Opening Polymerization of □-Caprolactone in Supercritical Carbon Dioxide," Macromolecules, vol. 39, pp. 7967-7972, (2006).
Machiko Hori et al., "Uniform amplification of multiple DNAs by emulsion PCR," Biochemical and Biophysical Research Communications, vol. 352, pp. 323-328, (2007).
Frank Diehl et al., "Digital quantification of mutant DNA in cancer patients," Current Opinion in Oncology, vol. 19, pp. 36-42, (2007).
Delai L. Chen et al., "Using Three-Phase Flow of Immiscible Liquids to Prevent Coalescence of Droplets in Microfluidic Channels: Criteria to Identify the Third Liquid and Validation with Protein Crystallization," Langmuir, vol. 23, No. 4, pp. 2255-2260, (2007).
S. Mohr et al., "Numerical and experimental study of a droplet-based PCR chip," Microfluid Nanofluid, vol. 3, pp. 611-621, (2007).
Sigrun M. Gustafsdottir et al., "In vitro analysis of DNA-protein interactions by proximity ligation," PNAS, vol. 104, No. 9, pp. 3067-3072, Feb. 27, 2007.
Daniel J. Diekema et al., "Look before You Leap: Active Surveillance for Multidrug-Resistant Organisms," Healthcare Epidemiology • CID 2007:44, pp. 1101-1107 (Apr. 15), electronically published Mar. 2, 2007.
Charles N. Baroud et al., "Thermocapillary valve for droplet production and sorting," Physical Review E 75, 046302, pp. 046302-1-046302-5, Apr. 5, 2007.
Qinyu Ge et al., "Emulsion PCR-based method to detect Y chromosome microdeletions," Analytical Biochemistry, vol. 367, pp. 173-178, May 10, 2007.

(56) References Cited

OTHER PUBLICATIONS

Chunsun Zhang et al., "Miniaturized PCR chips for nucleic acid amplification and analysis: latest advances and future trends," Nucleic Acids Research, vol. 35, No. 13, pp. 4223-4237, Jun. 18, 2007.
Y. M. Dennis Lo et al., "Digital PCR for the molecular detection of fetal chromosomal aneuploidy," PNAS, vol. 104, No. 32, pp. 13116-13121, Aug. 7, 2007.
Dayong Jin et al., "Practical Time-Gated Luminescence Flow Cytometry. II: Experimental Evaluation Using UV LED Excitation," Cytometry Part A • 71A, pp. 797-808, Aug. 24, 2007.
Helen R. Hobbs et al., "Homogeneous Biocatalysis in both Fluorous Biphasic and Supercritical Carbon Dioxide Systems," Angewandte Chemie, vol. 119, pp. 8006-8009, Sep. 6, 2007.
Nathan Blow, "PCR's next frontier," Nature Methods, vol. 4, No. 10, pp. 869-875, Oct. 2007.
Nicole Pamme, "continuous flow separations in microfluidic devices," Lab on a Chip, vol. 7, pp. 1644-1659, Nov. 2, 2007.
Yuejun Zhao et al., "Microparticle Concentration and Separation by Traveling-Wave Dielectrophoresis (twDEP) for Digital Microfluidics," Journal of Microelectromechanical Systems, vol. 16, No. 6, pp. 1472-1481, Dec. 2007.
Sigma-Aldrich, "Synthesis of Mesoporous Materials," Material Matters, 3.1, 17, (2008).
Nick J. Carroll et al., "Droplet-Based Microfluidics for Emulsion and Solvent Evaporation Synthesis of Monodisperse Mesoporous Silica Microspheres," Langmuir, vol. 24, No. 3, pp. 658-661, Jan. 3, 2008.
Shia-Yen Teh et al., "Droplet microfluidics," Lab on a Chip, vol. 8, pp. 198-220, Jan. 11, 2008.
Chloroform (Phenomenex), Solvent Miscibility Table, Internet Archive WayBackMachine, 3 pgs., Feb. 1, 2008.
N. Reginald Beer et al., "On-Chip Single-Copy Real-Time Reverse-Transcription PCR in Isolated Picoliter Droplets," Analytical Chemistry, vol. 80, No. 6, pp. 1854-1858, Mar. 15, 2008.
Palani Kumaresan et al., "High-Throughput Single Copy DNA Amplification and Cell Analysis in Engineered Nanoliter Droplets," Analytical Chemistry, 17 pgs., Apr. 15, 2008.
Somil C. Mehta et a., "Mechanism of Stabilization of Silicone Oil—Water Emulsions Using Hybrid Siloxane Polymers," Langmuir, vol. 24, No. 9, pp. 4558-4563, Mar. 26, 2008.
Mohamed Abdelgawad et al., "All-terrain droplet actuation," Lab on a Chip, vol. 8, pp. 672-677, Apr. 2, 2008.
Lung-Hsin Hung et al., "Rapid microfabrication of solvent-resistant biocompatible microfluidic devices," Lab on a Chip, vol. 8, pp. 983-987, Apr. 8, 2008.
Jenifer Clausell-Tormos et al., "Droplet-Based Microfluidic Platforms for the Encapsulation and Screening of Mammalian Cells and Multicellular Organisms," Chemistry & Biology, vol. 15, pp. 427-437, May 2008.
Vivienne N. Luk et al., "Pluronic Additives: A Solution to Sticky Problems in Digital Microfluidics," Langmuir, vol. 24, No. 12, pp. 6382-6289, May 16, 2008.
Yen-Heng Lin et al., "Droplet Formation Utilizing Controllable Moving-Wall Structures for Double-Emulsion Applications," Journal of Microelectromechanical Systems, vol. 17, No. 3, pp. 573-581, Jun. 2008.
Simant Dube et al., "Mathematical Analysis of Copy Number Variation in a DNA Sample Using Digital PCR on a Nanofluidic Device," PLoS One, vol. 3, Issue 8, pp. 1-9, Aug. 6, 2008.
Jian Qin et al., "Studying copy number variations using a nanofluidic platform," Nucleic Acids Research, vol. 36, No. 18, pp. 1-8, Aug. 18, 2008.
C. Holtze et al., "Biocompatible surfactants for water-in-fluorocarbon emulsions," Lab on a Chip, vol. 8, pp. 1632-1639, Sep. 2, 2008.
Margaret Macris Kiss et al., "High-Throughput Quantitative Polymerase Chain Reaction in Picoliter Droplets," Analytical Chemistry, 8 pgs., downloaded Nov. 17, 2008.
Jay Shendure et al., "Next-generation DNA sequencing," Nature Biotechnology, vol. 26, No. 10, pp. 1135-1145, Oct. 2008.
Bernhard G. Zimmermann et al., "Digital PCR: a powerful new tool for noninvasive prenatal diagnosis?," Prenatal Diagnosis, vol. 28 pp. 1087-1093, Nov. 10, 2008.
Avishay Bransky et al., "A microfluidic droplet generator based on a piezoelectric actuator," Lab on a Chip, vol. 9, pp. 516-520, Nov. 20, 2008.
David A. Weitz, "Novel Surfactants for Stabilizing Emulsions of Water or Hydrocarbon Oil-Based Droplets in a Fluorocarbon Oil Continuous Phase," Harvard Office of Technology Development: Available Technologies, pp. 1-3, downloaded Nov. 24, 2008.
Richard M. Cawthon, "Telomere length measurement by a novel monochrome multiplex quantitative PCR method," Nucleic Acids Research, vol. 37, No. 3, pp. 1-7, (2009).
Anthony J. O'Lenick, Jr., "Silicone Emulsions and Surfactants—A Review," Silicone Spectator, Silitech LLC, Mar. 2009 (original published May 2000).
Adam R. Abate et al., "Functionalized glass coating for PDMS microfluidic devices," Lab on a Chip Technology: Fabrication and Microfluidics, 11 pgs., (2009).
Chia-Hung Chen et al., "Janus Particles Templated from Double Emulsion Droplets Generated Using Microfluidics," Langmuir, vol. 29, No. 8, pp. 4320-4323, Mar. 18, 2009.
Luis M. Fidalgo et al., "Coupling Microdroplet Microreactors with Mass Spectrometry: Reading the Contents of Single Droplets Online," Angewandte Chemie, vol. 48, pp. 3665-3668, Apr. 7, 2009.
Linas Mazutis et al., "A fast and efficient microfluidic system for highly selective one-to-one droplet fusion," Lab on a Chip, vol. 9, pp. 2665-2672, Jun. 12, 2009.
Frank McCaughan et al., "Single-molecule genomics," Journal of Pathology, vol. 220, pp. 297-306, Nov. 19, 2009.
Suzanne Weaver et al., "Taking qPCR to a higher level: Analysis of CNV reveals the power of high throughput qPCR to enhance quantitative resolution," Methods, vol. 50, pp. 271-276, Jan. 15, 2010.
Amelia L. Markey et al., "High-throughput droplet PCR," Methods, vol. 50, pp. 277-281, Feb. 2, 2010.
Yoon Sung Nam et al., "Nanosized Emulsions Stabilized by Semi-solid Polymer Interphase," Langmuir, ACS Publications, Jul. 23, 2010.
Tatjana Schütze et al., "A streamlined protocol for emulsion polymerase chain reaction and subsequent purification," Analytical Biochemistry, vol. 410, pp. 155-157, Nov. 25, 2010.
Somanath Bhat et al., "Effect of sustained elevated temperature prior to amplification on template copy number estimation using digital polymerase chain reaction," Analyst, vol. 136, pp. 724-732, (2011).
James G. Wetmur, et al., "Linking Emulsion PCR Haplotype Analysis," PCR Protocols, Methods in Molecular Biology, vol. 687, pp. 165-175, (2011).
Paul Vulto et al., "Phaseguides: a paradigm shift in microfluidic priming and emptying," Lab on a Chip, vol. 11, No. 9, pp. 1561-1700, May 7, 2011.
Thinxxs Microtechnology AG, "Emerald Biosystems: Protein Crystallization," 1 pg., downloaded Mar. 8, 2011.
Qun Zhong et al., "Multiplex digital PCR: breaking the one target per color barrier of quantitative PCR," Lab on a Chip, vol. 11, pp. 2167-2174, (2011).
Jiaqi Huang et al., "Rapid Screening of Complex DNA Samples by Single-Molecule Amplification and Sequencing," PLoS One, vol. 6, Issue 5, pp. 1-4, May 2011.
Burcu Kekevi et al., Synthesis and Characterization of Silicone-Based Surfactants as Anti-Foaming Agents, J. Surfact Deterg (2012), vol. 15, pp. 73-81, published online Jul. 7, 2011.
Leonardo B. Pinheiro et al., "Evaluation of a Droplet Digital Polymerase Chain Reaction Format for DNA Copy Number Quantification," Analytical Chemistry, vol. 84, pp. 1003-1011, Nov. 28, 2011.
Nicole L. Solimini et al., "Recurrent Hemizygous Deletions in Cancers May Optimize Proliferative Potential," Science, vol. 337, pp. 104-109, Jul. 6, 2012.
Labsmith, "Microfluid Components" webpage, downloaded Jul. 11, 2012.
Labsmith, "CapTite™ Microfluidic Interconnects" webpage, downloaded Jul. 11, 2012.

(56) References Cited

OTHER PUBLICATIONS

Nathan A. Tanner et al., "Simultaneous multiple target detection in real-time loop-mediated isothermal amplification," BioTechniques, vol. 53, pp. 81-89, Aug. 2012.
Philippe Bécamel, Authorized Officer, The International Bureau of WIPO, "International Preliminary Report on Patentability," in connection with related PCT Patent App. No. PCT/US2011/030097, 12 pgs., Sep. 25, 2012.
A. Scherer, California Institute of Technology, "Polymerase Chain Reactors" PowerPoint presentation, 24 pgs., date unknown.
Eschenbach OPTIK GMBH, Optics for Concentrated Photovoltaics (CPV), 1 pg., date unkown.
European Patent Office, "Extended Search Report" in connection with related European Patent App. No. 11760357.1, dated Dec. 2, 2013, 6 pages.
Japanese Patent Office, "Notice of Reasons for Rejection" in connection with related Japanese Patent Application No. 2013-501535, dated Mar. 2, 2015, 6 pages.
European Patent Office, "Examination Report" in connection with related European Patent App. No. 11760357.1, dated Dec. 1, 2014, 5 pages.

* cited by examiner

DROPLET TRANSPORT SYSTEM FOR DETECTION

CROSS-REFERENCES TO PRIORITY APPLICATIONS

This application is a continuation of PCT Patent Application Serial No. PCT/US2011/030077, filed Mar. 25, 2011, which, in turn, claims the benefit under 35 U.S.C. §119(e) of the following U.S. provisional patent applications: Ser. No. 61/341,065, filed Mar. 25, 2010; and Ser. No. 61/467,347, filed Mar. 24, 2011. Each of these priority applications is incorporated herein by reference in its entirety for all purposes.

CROSS-REFERENCES TO OTHER MATERIALS

This application incorporates by reference in its entirety for all purposes each of the following materials: U.S. Pat. No. 7,041,481, issued May 9, 2006; U.S. Patent Application Publication No. 2010/0173394 A1, published Jul. 8, 2010; and Joseph R. Lakowicz, Principles of Fluorescence Spectroscopy ($2^{nd}$ Ed. 1999).

INTRODUCTION

Many biomedical applications rely on high-throughput assays of samples. For example, in research and clinical applications, high-throughput genetic tests using target-specific reagents can provide high-quality information about samples for drug discovery, biomarker discovery, and clinical diagnostics, among others. As another example, infectious disease detection often requires screening a sample for multiple genetic targets to generate high-confidence results.

Emulsions hold substantial promise for revolutionizing high-throughput assays. Emulsification techniques can create billions of aqueous droplets that function as independent reaction chambers for biochemical reactions. For example, an aqueous sample (e.g., 200 microliters) can be partitioned into droplets (e.g., four million droplets of 50 picoliters each) to allow individual sub-components (e.g., cells, nucleic acids, proteins) to be manipulated, processed, and studied discretely in a massively high-throughput manner.

Aqueous droplets can be suspended in oil to create a water-in-oil emulsion (W/O). The emulsion can be stabilized with a surfactant to reduce or prevent coalescence of droplets during heating, cooling, and transport, thereby enabling thermal cycling to be performed. Accordingly, emulsions have been used to perform single-copy amplification of nuclei acid target molecules in droplets using the polymerase chain reaction (PCR). The fraction of the droplets that are positive for a target can be used to estimate the concentration of the target in a sample.

Despite their allure, emulsion-based assays present technical challenges for high-throughput testing. As an example, the arrangement and packing density of droplets may need to be changed substantially during an assay. In a batch mode of nucleic acid amplification, droplets of an emulsion (or an array of emulsions) may be reacted in synchrony (e.g., thermally cycled in a thermal cycler) while the emulsion(s) remains generally stationary with respect to a container holding the emulsion(s). After thermal cycling, the droplets may need to be transferred to an examination site, such as serially by fluid flow, to collect data on the droplets. Thus, there is a need for systems capable of transferring droplets from a container (or an array of containers) to an examination site by fluid flow.

SUMMARY

The present disclosure provides a system, including methods and apparatus, for transporting droplets from a tip to an examination site for detection.

DETAILED DESCRIPTION

Figure 1:
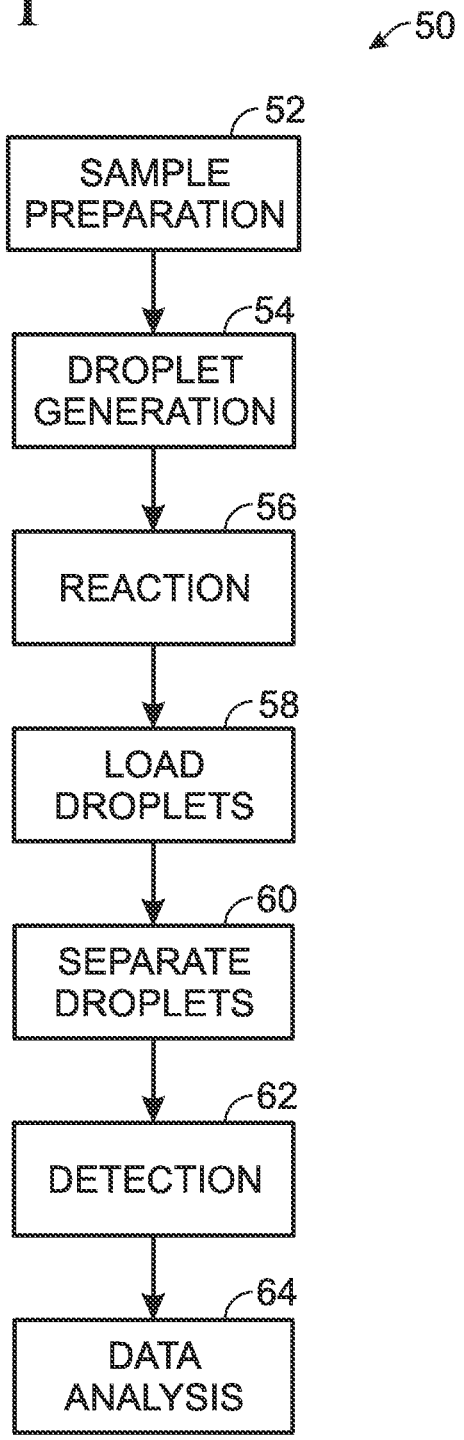
FIG. 1 is a flowchart listing exemplary steps that may be performed in a method of sample analysis using droplets and droplet-based assays, in accordance with aspects of the present disclosure.

The present disclosure provides a system, including methods and apparatus, for transporting droplets from a tip to an examination site for detection.

The transport systems disclosed herein may involve fluidics layouts for transporting droplets from containers, such as reaction vessels, to an examination region of a detection unit by fluid flow. These systems may involve, among others, (A) preparing a sample, such as a clinical or environmental sample, for analysis, (B) separating components of the samples by partitioning them into droplets or other partitions, each optionally containing only about one or less copy of a nucleic acid target (DNA or RNA) or other analyte of interest (e.g., a protein molecule or complex), (C) performing an amplification and/or other reaction within the droplets to generate a product(s), where successful occurrence of the amplification or other reaction in each droplet is dependent on the presence of the copy of target or analyte in the droplet, (D) detecting the product(s), or a characteristic(s) thereof, and/or (E) analyzing the resulting data. In this way, complex samples may be converted into a plurality of simpler, more easily analyzed samples, with concomitant reductions in background and assay times.

A method of transporting droplets for detection is provided. In the method, a tip may be disposed in contact with an emulsion including droplets. The tip may include an outer channel and an inner channel each disposed in fluid communication with a channel network. Droplets may be loaded from the emulsion into the channel network via the inner channel. Loaded droplets may be moved to an examination region of the channel network.

A system for transporting droplets for detection is provided. The system may comprise a tip configured to contact an emulsion and including an outer channel and an inner channel. The system also may comprise a channel network including an examination region and also may comprise one or pressure sources and a detector. The one or more pressure sources may be capable of applying pressure independently to the outer channel and the inner channel via the channel network and configured to load droplets of the emulsion into the channel network via the inner channel and to drive loaded droplets to the examination region. The detector may be configured to detect light from fluid flowing through the examination region.

Another method of transporting droplets for detection provided. In the method, a tip may be disposed in contact with an emulsion including aqueous droplets disposed in a continuous phase. Droplets from the emulsion may be loaded into a channel network via by the tip. Loaded droplets may be moved to an examination region of the channel network. A cleaning fluid that is substantially more hydrophilic than the continuous phase may be driven through the tip. The steps of disposing, loading, and moving may be repeated with another emulsion.

Another system for transporting droplets for detection is provided. The system may comprise a tip and a channel network including an examination region. The system also may comprise one or more pressure sources configured to load droplets of an emulsion into the channel network via the tip and to drive loaded droplets to the examination region. The system further may comprise a first fluid source and a second fluid source each operatively connected to at least one of the pressure sources. The first fluid source may provide a cleaning fluid that is substantially more hydrophilic than a fluid provided by the second fluid source. The system also may comprise a detector operatively connected to the examination region.

Yet another method of transporting droplets for detection is provided. In the method, a tip may be disposed in contact with an emulsion including droplets. Droplets may be loaded from the emulsion via the tip into a flow path that is open between the loaded droplets and an examination region and closed downstream of the examination region. The flow path may be opened downstream of the examination region. Droplets may be driven through the examination region.

Still another method of droplet transport for detection is provided. In the method, a tip may be disposed in contact with an emulsion including droplets. Droplets may be loaded from the emulsion via the tip, with pressure from a first pressure source, and into a holding channel that is upstream of a confluence region and an examination region. Droplets may be driven to the confluence region with pressure from a second pressure source. Droplets may be driven through the examination region with pressure from both the first and second pressure sources.

Still yet another method of transporting droplets for detection is provided. A tip may be disposed in contact with an emulsion including droplets. Fluid may be driven on a first path through a valve in a first configuration, to load droplets from the emulsion into a channel network via by the tip. The valve may be placed in a second configuration. Droplets may be moved through an examination region of the channel network by driving fluid on at least a second path and a third path through the valve in the second configuration. Light may be detected from the examination region as droplets move through the examination region.

Yet another system for transporting droplets for detection is provided. The system may comprise a tip and a channel network. The channel network may include a valve including a plurality of ports and having a first configuration and a second configuration. The channel network also may include a plurality of channels connected to ports of the valve, with at least one of the channels extending along a flow path to an examination region for droplets. The system further may comprise at least two pressure sources operatively connected to the channel network and also may comprise a detector operatively connected to the examination region. In the first configuration at least one of the pressure sources may be configured to drive fluid through a communicating pair of the ports such that droplets are loaded into the channel network via the tip. In the second configuration, at least two of the pressure sources may be configured to drive fluid through two separate pairs of communicating ports such that an average distance between loaded droplets is increased before such droplets travel through the examination region.

I. OVERVIEW OF DROPLET-BASED ASSAYS

FIG. 1 shows an exemplary system 50 for performing a droplet-, or partition-, based assay. In brief, the system may include sample preparation 52, droplet generation 54, reaction 56 (e.g., amplification), droplet loading 58, droplet separation 60, detection 62, and data processing and/or analysis 64. The system may be utilized to perform a digital PCR (polymerase chain reaction) analysis. More specifically, sample preparation 52 may involve collecting a sample, such as a clinical or environmental sample, treating the sample to release an analyte (e.g., a nucleic acid or protein, among others), and forming a reaction mixture involving the analyte (e.g., for amplification of a target nucleic acid that is or corresponds to the analyte or that is generated in a reaction (e.g., a ligation reaction) dependent on the analyte). Droplet generation 54 may involve encapsulating the analyte and/or target nucleic acid in droplets, for example, with an average of about one copy or less of each analyte and/or target nucleic acid per droplet, where the droplets are suspended in an immiscible carrier fluid, such as oil, to form an emulsion. Reaction 56 may involve subjecting the droplets to a suitable reaction, such as thermal cycling to induce PCR amplification, so that target nucleic acids, if any, within the droplets are amplified to form additional copies. In some embodiments, thermal cycling may be performed in a batch mode, with the droplets held by one or more containers, and thus generally disposed in a static configuration that lacks net fluid flow. Droplet loading 58 may involve introducing droplets into a transport system from one or more containers holding emulsions of droplets. Droplet separation 60 may involve adding a dilution fluid to the droplets in the transport system, placing droplets in single file, and/or increasing the average distance between droplets (and/or decreasing the linear density of droplets in a channel (i.e., decreasing the number of droplets per unit length of channel)). Detection 62 may involve detecting some signal(s) from the droplets indicative of whether or not there was amplification. In some embodiments, detection may involve detecting light from droplets that are flowing through an examination site, such as flowing in single file and separated from each other. Finally, data analysis 64 may involve estimating a concentration of the analyte and/or target nucleic acid in the sample based on the percentage (e.g., the fraction) of droplets in which amplification occurred.

These and other aspects of the system are described in further detail below, particularly with respect to droplet transport systems, and in the patent documents listed above under Cross-References and incorporated herein by reference.

II. OVERVIEW OF DROPLET TRANSPORT

Figure 2:
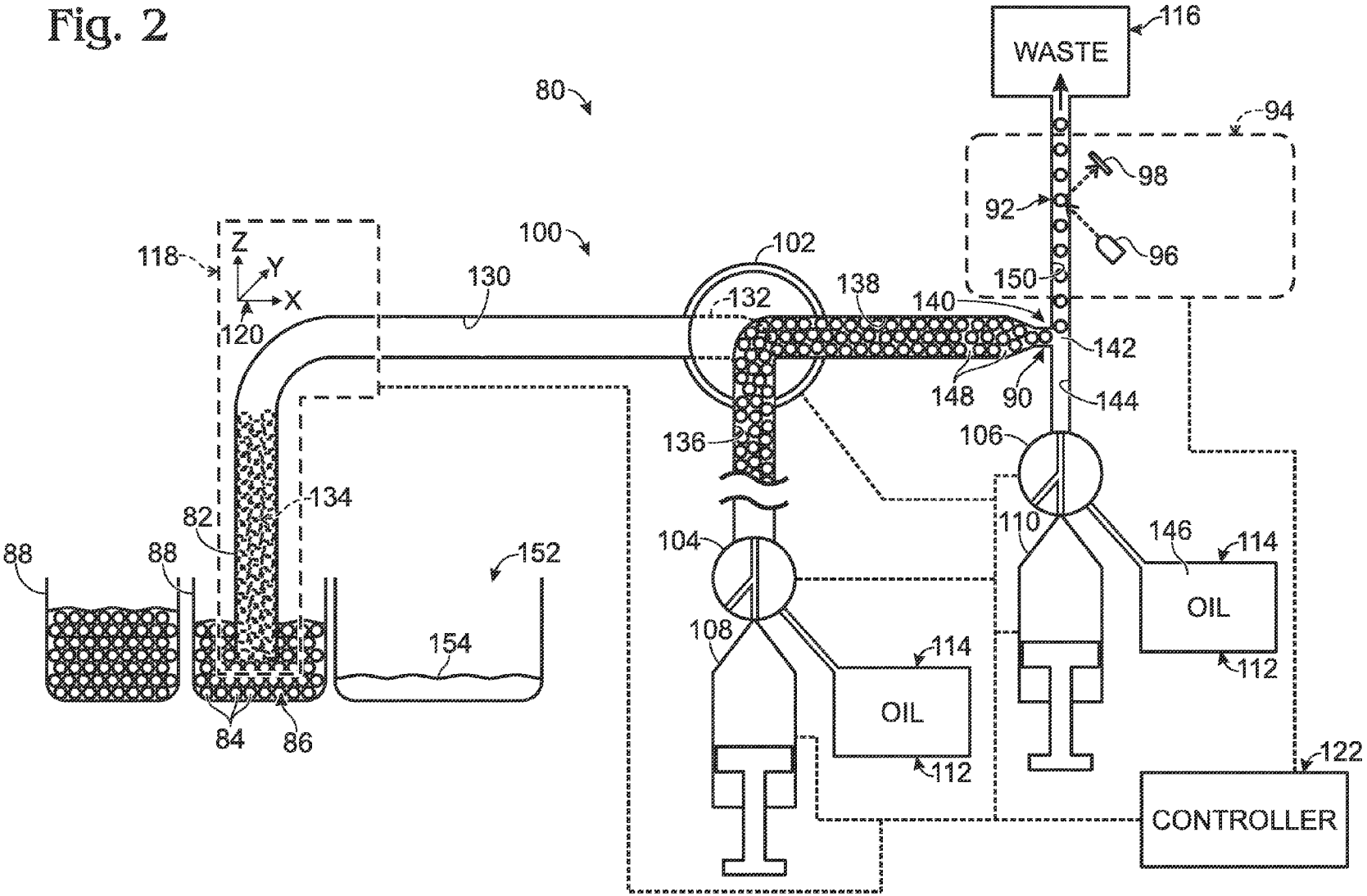
FIG. 2 is a schematic view of selected aspects of an exemplary droplet transport system for picking up droplets from a container, separating the droplets from each other, and driving the separated droplets serially through an examination region for detection, in accordance with aspects the present disclosure.

This Section describes an exemplary transport system 80 for conveying droplets from one or more containers to an examination region for detection; see FIG. 2.

Transport system 80 is configured to utilize a tip 82 to pick up droplets 84 in an emulsion 86 held by at least one container 88. The droplets may be queued and separated in a droplet arrangement region 90, and then conveyed serially through an examination region 92 for detection of at least one aspect of the droplets with at least one detection unit 94. The detection unit may include at least one light source 96 to illuminate examination region 92 and/or fluid/droplets therein, and at least one detector 98 to detect light received from the illuminated examination region (and/or fluid/droplets therein).

The transport system may include a channel network 100 connected to tip 82. The transport system may include channel-forming members (e.g., tubing and/or one or more chips) and at least one valve (e.g., valves 102, 104, and 106, which may include valve actuators) to regulate and direct fluid flow into, through, and out of the channel network. Fluid flow into, through, and out of channel network 100 may be driven by at least one pump, such as a sample pump 108 and a dilution pump 110. The fluid introduced into channel network 100 may be supplied by emulsion 86 and one or more fluid sources 112 formed by reservoirs 114 and operatively connected to one or more of the pumps. (A cleaning fluid also may be introduced via the tip.) Each fluid source may provide any suitable fluid, such as a hydrophobic fluid (e.g., oil), which may be miscible with the continuous phase of the emulsion and/or a carrier phase in the system, but not the dispersed phase of the droplets, or may provide a relatively more hydrophilic fluid for cleaning portions of the channel network and/or tip. Fluid that travels through examination region 92 may be collected in one or more waste receptacles 116.

A channel network may be any fluidics assembly including a plurality of channels. A channel network may include any combination of channels (e.g., formed by tubing, chips, etc.), one or more valves, one or more chambers, one or more pressure sources, fluid sources, etc.

The continuous phase, carrier fluid, and/or dilution fluid may be referred to as oil or an oil phase, which may include any liquid (or liquefiable) compound or mixture of liquid compounds that is immiscible with water. The oil may be synthetic or naturally occurring. The oil may or may not include carbon and/or silicon, and may or may not include hydrogen and/or fluorine. The oil may be lipophilic or lipophobic. In other words, the oil may be generally miscible or immiscible with organic solvents. Exemplary oils may include at least one silicone oil, mineral oil, fluorocarbon oil, vegetable oil, or a combination thereof, among others. In exemplary embodiments, the oil is a fluorinated oil, such as a fluorocarbon oil, which may be a perfluorinated organic solvent. A fluorinated oil includes fluorine, typically substituted for hydrogen. A fluorinated oil may be polyfluorinated, meaning that the oil includes many fluorines, such as more than five or ten fluorines, among others. A fluorinated oil also or alternatively may be perfluorinated, meaning that most or all hydrogens have been replaced with fluorine. An oil phase may include one or more surfactants.

Each pump may have any suitable structure capable of driving fluid flow. The pump may, for example, be a positive-displacement pump, such as a syringe pump, among others. Other exemplary pumps include peristaltic pumps, rotary pumps, or the like.

The position of tip 82 may be determined by a drive assembly 118 capable of providing relative movement of the tip and container(s) 88 along one or more axes, such as three orthogonal axes 120 in the present illustration. In other words, the drive assembly may move the tip while the container remains stationary, move the container while the tip remains stationary, or move both the tip and the container at the same or different times, among others. In some embodiments, the drive assembly may be capable of moving the tip into alignment with each container (e.g., each well of a multi-well plate), lowering the tip into contact with fluid in the container, and raising the tip above the container to permit movement of the tip to another container. The drive assembly may include one or more motors to drive tip/container movement, and one or more position sensors to determine the current position of the tip and/or container and/or changes in tip/container position. Accordingly, the drive assembly may offer control of tip position in a feedback loop.

Transport system 80 further may include a controller 122. The controller may control operation of, receive inputs from, and/or otherwise communicate with any other components of the transport system, such as detection unit 94, valves 102, 104, and 106 (e.g., via actuators thereof), pumps 108 and 110, and drive assembly 118, among others. For example, the controller may control light source operation and monitor the intensity of light generated, adjust detector sensitivity (e.g., by adjusting the gain), process signals received from the detector (e.g., to identify droplets and estimate target concentrations), and so on. The controller also or alternatively may control valve positions, tip movement (and thus tip position), pump operation (e.g., pump selection, direction of flow (i.e., generation of positive or negative pressure), rate of flow, volume dispensed, etc.), and the like. Accordingly, the controller may control when, where, and how fluid moves within the channel network 100. The controller may provide automation of any suitable operation or combination of operations. Accordingly, the transport system may be configured to load and examine a plurality of emulsions automatically without user assistance or intervention.

The controller may include any suitable combination of electronic components to achieve coordinated operation and control of system functions. The electronic components may be disposed in one site or may be distributed to different areas of the system. The controller may include one or more processors (e.g., digital processors, also termed central/computer processing units (CPUs)) for data processing and also may include additional electronic components to support and/or supplement the processors, such as switches, amplifiers, filters, analog to digital converters, busses, one or more data storage devices, etc. In some cases, the controller may include at least one master control unit in communication with a plurality of subordinate control units. In some cases, the controller may include a desktop or laptop computer. The controller may be connected to any suitable user interface, such as a display, a keyboard, a touchscreen, a mouse, etc.

Channel network 100 may include a plurality of channels or regions that receive droplets as the droplets travel from tip 82 to waste receptacle 116. The term "channel" will be used interchangeably with the term "line" in the explanation and examples to follow.

Tip 82 may form part of an intake channel or loading channel 130 that extends into channel network 100 from tip 82. Droplets may enter other regions of the channel network from loading channel 130. Droplets 84 in emulsion 86 may be introduced into loading channel 130 via tip 82 (i.e., picked up by the tip) by any suitable active or passive mechanism. For example, emulsion 86 may be pulled into the loading channel by a negative pressure created by a pump, i.e., by suction (also termed aspiration), may be pushed into the loading channel by a positive pressure applied to emulsion 86 in container 88, may be drawn into the loading channel by capillary action, or any combination thereof, among others.

In exemplary embodiments, pump 108 pulls the emulsion into loading channel 130 by application of a negative pressure. To achieve loading, valve 102 may be placed in a loading position indicated in phantom at 132, to provide fluid communication between tip 82 and pump 108. The pump then may draw the emulsion, indicated by phantom droplets at 134, into loading channel 130 via tip 82, with the tip in contact with the emulsion. The pump may draw the loaded droplets through valve 102 into a holding channel 136.

The loaded droplets may be moved toward detection unit 94 by driving the droplets from holding channel 136, through valve 102, and into a queuing channel 138. The queuing channel may place the droplets in single file, indicated at 140.

The droplets may enter a confluence region or separation region 142, optionally in single file, as they emerge from queuing channel 138. The confluence region may be formed at a junction of the queuing channel and at least one dilution channel 144. The dilution channel may supply a stream of dilution fluid 146 driven through confluence region 142, as droplets and carrier fluid/continuous phase 148 enter the confluence region as a stream from queuing channel 138. The dilution fluid may be miscible with the carrier fluid and serves to locally dilute the emulsion in which the droplets are disposed, thereby separating droplets by increasing the average distance between droplets.

The droplets may enter an examination channel 150 after they leave confluence region 142. The examination channel may include examination region 92, where the examination channel may be illuminated and light from the examination region may be detected.

Tip 82 may be utilized to load a series of emulsions from different containers. After droplets are loaded from a first container, the tip may be lifted to break contact with remaining fluid, if any, in the container. A volume of air may be drawn into the tip to serve as a barrier between sets of loaded droplets and/or to prevent straggler droplets from lagging behind as the droplets travel through the channel network. In any event, the tip next may be moved to a wash station 152, wherein tip 82 may be cleaned by flushing, rinsing, and/or immersion. More particularly, fluid may be dispensed from and/or drawn into the tip at the wash station, and the tip may or may not be placed into contact with a fluid 154 in the wash station during cleaning (e.g., decontamination). The cleaned tip then may be aligned with and lowered into another container, to enable loading of another emulsion.

A transport system may include any combination of at least one vessel (i.e., a container) to hold at least one emulsion (and/or a set of vessels to hold an array of emulsions), at least one pick-up tip to contact the emulsion(s) and receive droplets from the emulsion, one or more fluid drive mechanisms to generate positive and/or negative pressure (i.e., one or more pumps to pull and/or push fluid into or out of the tip and/or through a detection site), a positioning mechanism for the tip and/or vessel (to move the tip with respect to the vessel or vice versa), one or more valves to select and change flow paths, at least one examination region to receive droplets for detection, or any combination thereof, among others.

These and other aspects of droplet reactions performed in vessels in static/batch mode, droplet transport systems, and detection systems are described in further detail in the patent documents listed above under Cross-References and incorporated herein by reference.

III. EXAMPLES

The following examples describe selected aspects and embodiments of droplet transport systems for detection of droplets. These examples are intended for illustration only and should not define or limit the entire scope of the present disclosure.

Example 1

Exemplary Transport Systems with a Two-State Multi-port Valve

Figure 3:
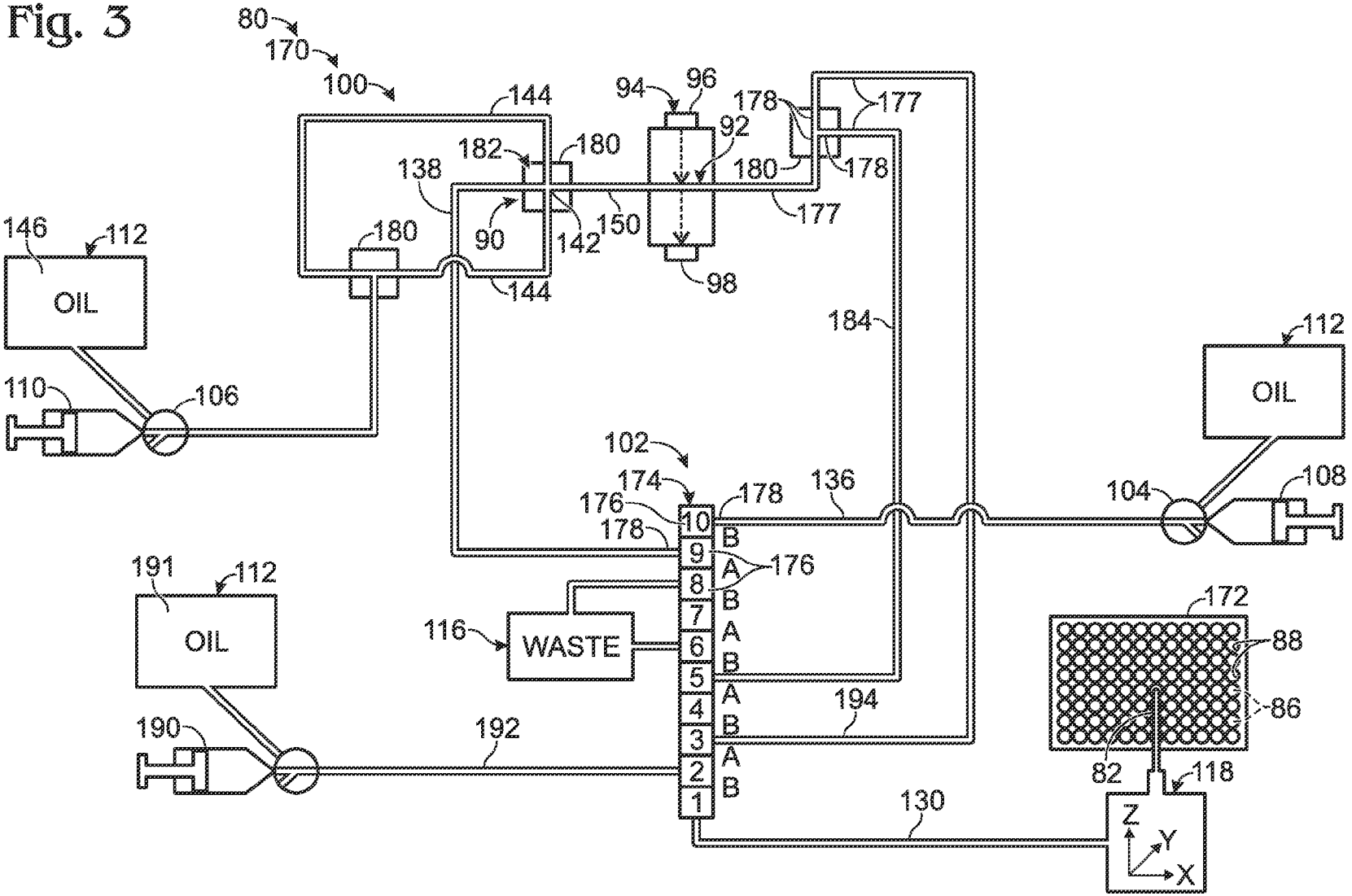
FIG. 3 is a schematic view of selected aspects of a first exemplary embodiment of the droplet transport system of FIG. 2, with the system including a two-position multiport valve and a third pump for cleaning channels, in accordance with aspects of the present disclosure.
Figure 4:
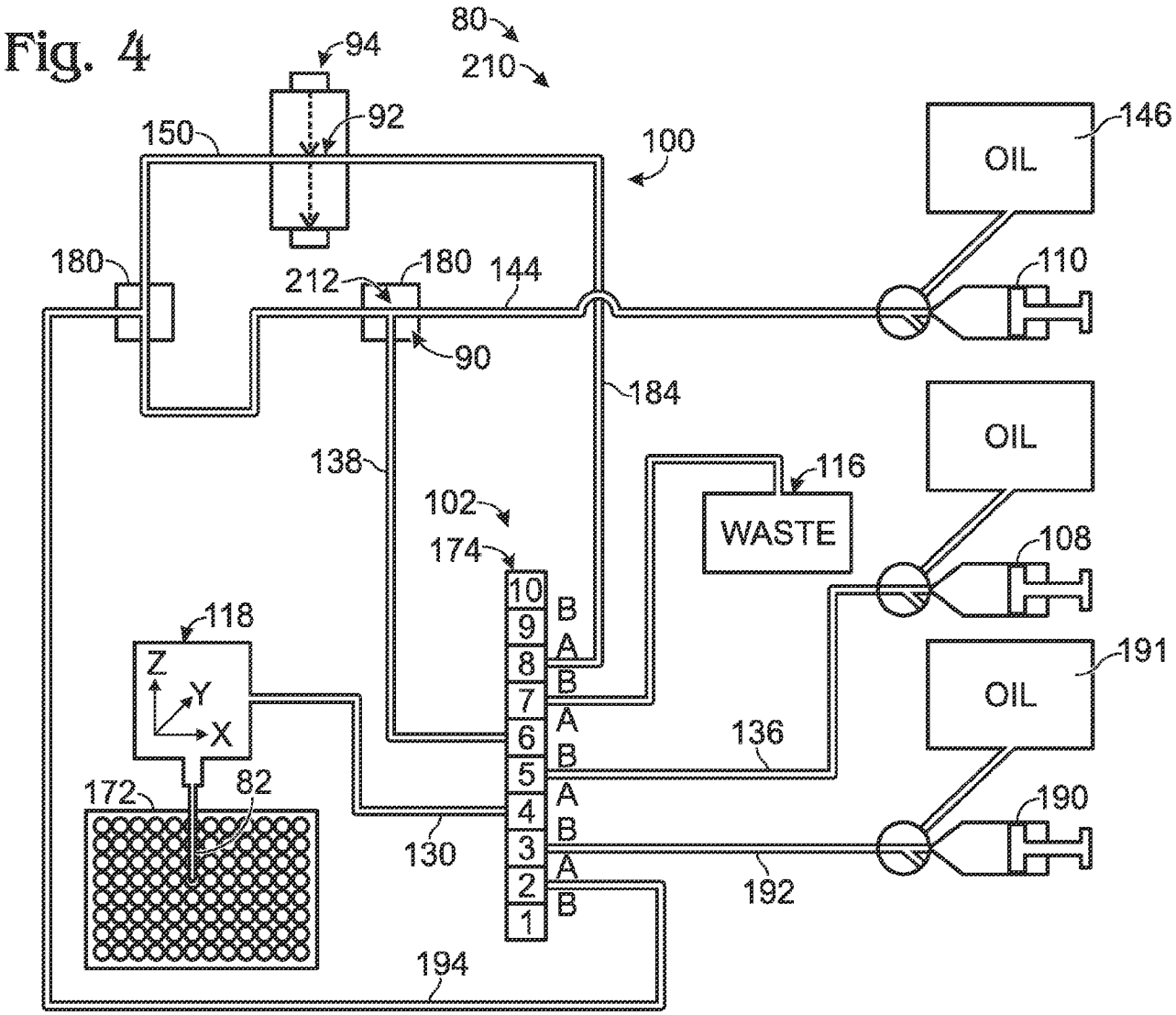
FIG. 4 is a schematic view of selected aspects of a second exemplary embodiment of the droplet transport system of FIG. 2, with the system including a two-position multiport valve and a third pump for cleaning channels, in accordance with aspects of the present disclosure.

This example describes exemplary droplet transport systems with a two-state (i.e., two-configuration) multi-port valve to permit switching between two sets of channel connections utilized by three pumps; see FIGS. 3 and 4.

FIG. 3 shows an exemplary embodiment 170 of droplet transport system 80 of FIG. 2. Transport system 170 may include any combination of the components and features disclosed herein for other transport systems.

Transport system 170 operates generally as described above for transport system 80, with counterpart elements of system 170 functioning similarly, except where noted below, and being assigned the same reference numbers as those of system 80.

Emulsions may be held by a multi-well plate 172, which provides containers 88 (i.e., wells) for individual emulsions 86. The droplets of each emulsion may, for example, be thermally cycled as a batch before loading them into transport system 170. Thermal cycling may have been performed with emulsions held by plate 172, or the emulsions may be transferred to the plate after thermal cycling or other suitable incubation has been performed.

System 170 may be equipped with a multi-port valve 174. The valve has a plurality of ports, such as least four, six, eight, or ten, at which channels of channel network 100 may be connected. For example, here, valve 174 has ten ports 176 labeled sequentially as 1 through 10. Some of the ports, such as ports 4 and 7 in the present illustration, may be plugged, but available for connection of additional channels, if needed, to add functionality to the system.

Valve 174 may be described as a multi-state or multi-configuration valve, with at least two states/configurations. In each configuration, the valve may place one or more pairs of channels in paired fluid communication with each other. Here, valve 174 is configured as a two-state valve, with the two configurations labeled as "A" and "B." In configuration A, adjacent pairs of ports, namely, ports 2 and 3, 4 and 5, 6 and 7, and 8 and 9 are in pair-wise fluid communication. The ports may be arranged in a circle (e.g., see Example 5), so ports 10 and 1 also are in fluid communication. In configuration B, the pairings are offset by one, namely, the following pairs of ports are in fluid communication: 1 and 2, 3 and 4, 5 and 6, 7 and 8, and 9 and 10.

Channels of channel network 100 may be defined substantially or at least predominantly by pieces of tubing 177. Each piece of tubing may or may not be capillary tubing (i.e., having an internal diameter of less than about 2 or 1 mm, among others). Two or more ends 178 of the tubing may be connected to one another by valve 174, in an adjustable configuration, or may be connected in a fixed configuration using connectors 180 (illustrated as squares where channels meet). Each connector may define connector channels that communicate with tubing channels. Also, each connector may define a counterbore aligned with each connector channel and sized to receive an end of the tubing. Fittings may be engaged with the connector to secure pieces of tubing to the connector.

At least one of connectors 180 may form a spacer 182, also termed a separator or singulator, for dilution of the emulsion before examination. Here, spacer 182 has a cross shape, with two dilution channels 144 and one queuing channel 138 forming confluence region 142 that feeds separated droplets to examination channel 150. In other cases, spacer has only one dilution channel (e.g., a T-shaped spacer), or three or more dilution channels.

Transport system 170 may operate as follows. Valve 174 may be placed in configuration A, to connect ports 1 and 10, which provides fluid communication between loading channel 130 and holding channel 136. Sample pump 108 may be operated to create a negative pressure, which draws an emulsion 86 from well 88, through tip 82 and loading channel 130, into holding channel 136. Valve 174 then may be may be placed in configuration B, to connect ports 9 and 10, which provides fluid communication between holding channel 136 and queuing channel 138. Pump 108 again may be operated but in this case to create positive pressure that pushes emulsion 86 from holding channel 136 to queuing channel 138.

Before droplets of the emulsion reach spacer 182, dilution pump 110 may be operated to create a positive pressure that pushes dilution fluid 146 through dilution channels 144 to spacer 182. As a result, the emulsion is diluted with dilution fluid as droplets enter confluence region 142 of the spacer. Separated droplets then travel along examination channel 150, through examination region 92 for detection, and enter a waste line 184.

Waste line 184 is in fluid communication with waste receptacle 116, with valve 174 in its current configuration, namely, configuration B, because port 5 is connected to port 6. Accordingly, continued positive pressure from pump 108 pushes droplets from waste line 184, through ports 5 and 6 of valve 174, and into the waste receptacle.

System 170 may include a third pump, namely, a cleaning pump 190, that provides a cleaning capability, by flushing channels with a cleaning fluid 191, which may be the same as, or different from, dilution fluid 146. Channel network 100 may be configured to permit back flushing by pump 190 when valve 174 is in the loading configuration (configuration A) or the examination configuration (configuration B). Here, pump 190 can back flush with valve 174 in configuration A. The pump pushes cleaning fluid 191 through a first back-flush channel 192, ports 2 and 3, a second back-flush channel 194, through examination channel 150 and queuing channel 138, and finally to the waste receptacle via ports 8 and 9. Cleaning pump 190 thus drives flow of fluid in reverse through channels 138 and 150. This reverse flow can serve to remove any residual droplets from these channels before another cycle of loading and examination with a different emulsion and/or may remove debris and/or clogs, which may collect or form where the flow path has a minimum diameter, such as in spacer 182.

Sample pump 108 also may be operated for cleaning with valve 174 in configuration A. The pump can push flushing fluid, such as oil, through holding channel 136, ports 10 and 1, loading channel 130, and tip 82. This back flushing may be performed with tip 82 disposed over a wash station and/or a well of the plate.

FIG. 4 shows another exemplary embodiment 210 of droplet transport system 80 of FIG. 2. Transport system 210 may include any combination of the components and features disclosed herein for other transport systems.

Transport system 210 operates generally as described above for transport system 170, with counterpart elements of system 210 functioning similarly, except where noted below, and being assigned the same reference numbers as those of system 170. However, system 210 includes a droplet arrangement region 90 formed by a T-shaped spacer 212, instead of spacer 182 with a cross (see FIG. 3).

System 210 may use sample pump 108 to pull droplets into loading channel 130 and holding channel 136 with valve 174 in configuration A. After changing valve 174 to configuration B, sample pump 108 may push the loaded emulsion through queuing channel 138 to spacer 212. Dilution pump 110 may concurrently push dilution fluid 146 through the spacer to form a train of spaced droplets for detection at detection unit 94. After passing through examination region 92, droplets may proceed to waste line 184 and finally to waste receptacle 116 via valve ports 7 and 8.

Valve 174 then may be placed back into configuration A for cleaning. Sample pump 108 may push fluid through loading 130 and out tip 82, and cleaning pump 190 may push fluid through channels 192, 194, and 150.

Example 2

Exemplary Transport System with a Coaxial Tip

This example describes an exemplary droplet transport system with a coaxial tip; see FIGS. 5-9.

Figure 5:
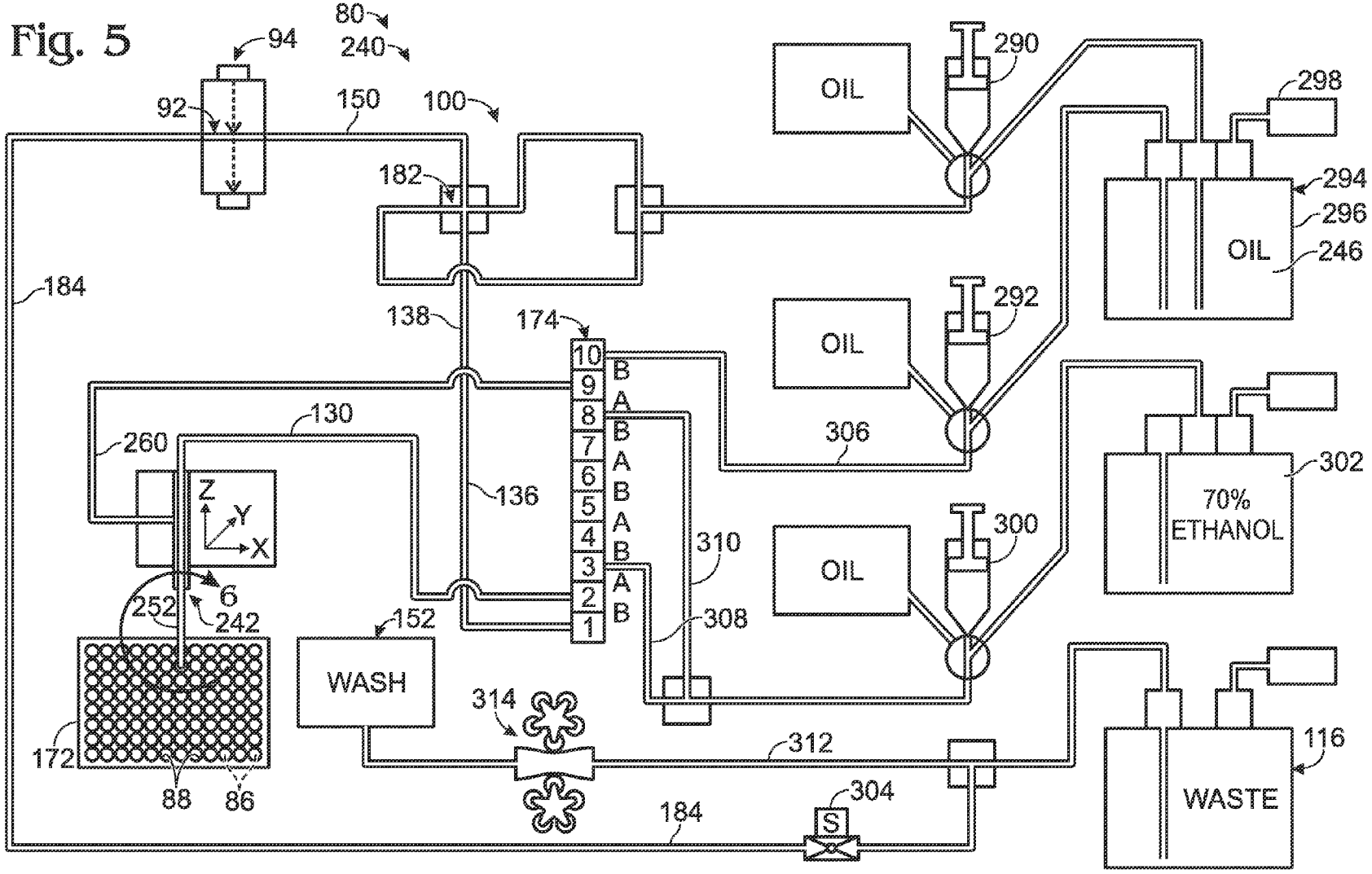
FIG. 5 is a schematic view of selected aspects of a third exemplary embodiment of the droplet transport system of FIG. 2, with the system including a coaxial tip for picking up droplets, in accordance with aspects of the present disclosure.

FIG. 5 shows an exemplary embodiment 240 of droplet transport system 80 of FIG. 2. Transport system 240 may include any combination of the components and features disclosed herein for other transport systems. Transport system 240 operates generally as described above for transport systems 80 and 170, with counterpart elements functioning similarly, except where noted below, and being assigned the same reference numbers. However, system 240 may incorporate a number of new components and features as described below, such as a coaxial tip 242.

Figure 6:
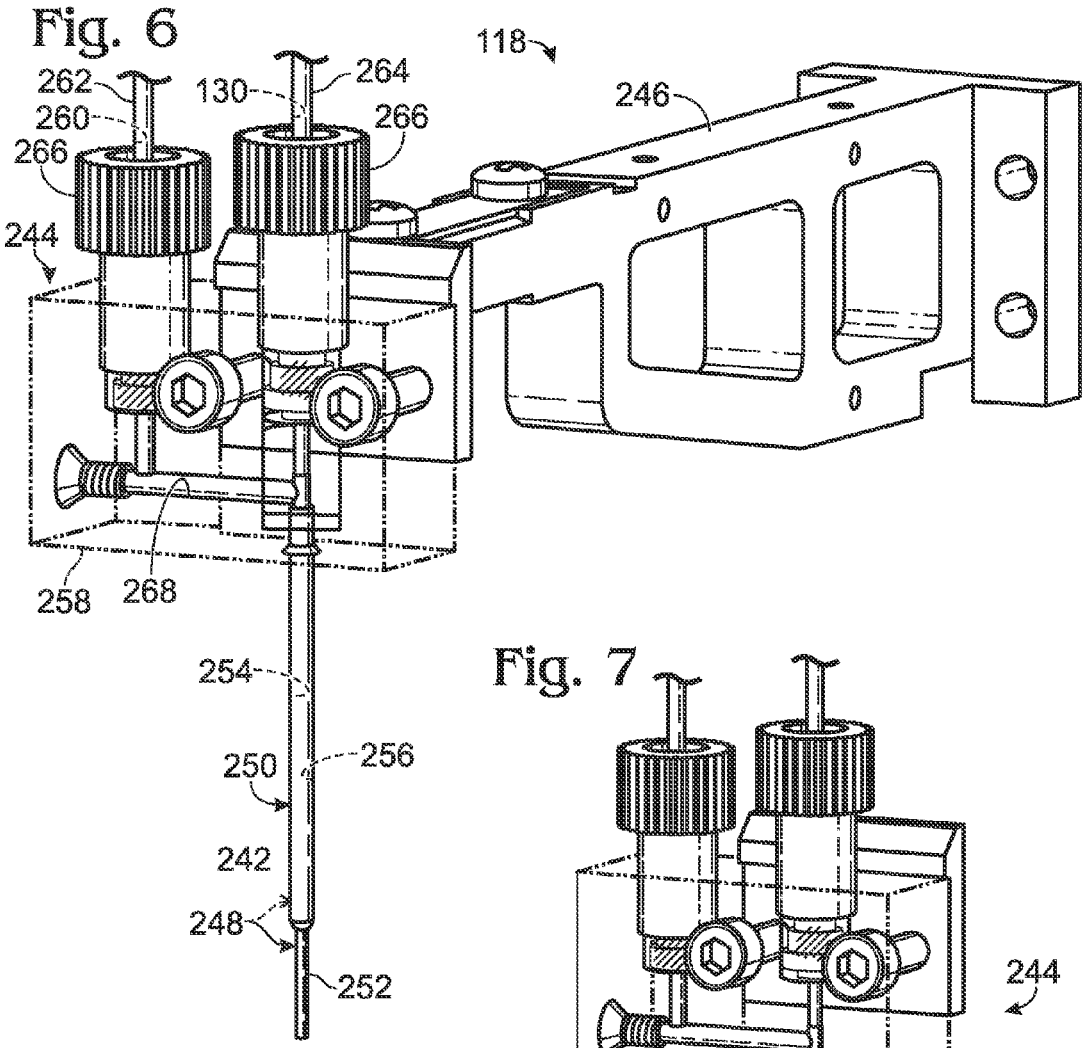
FIG. 6 is a fragmentary view of a drive assembly of the transport system of FIG. 5, taken generally at the region indicated at "6" in FIG. 5, to show the coaxial tip, an interconnect supporting the tip, and an arm of the drive assembly supporting the interconnect, in accordance with aspects of the present disclosure.

FIG. 6 shows a fluidic assembly 244 including tip 242, with the assembly supported by an arm 246 of drive assembly 118. Tip 242 may include an inner tube 248 and an outer tube 250 arranged coaxially. Inner tube 248 may project from the lower end of outer tube 250 to form a nose 252. Nose may have any suitable length, such as about 0.2 to 2 cm among others. Inner tube 248 and outer tube 250 define respective, coaxial inner channel 254 and outer channel 256.

Fluidic assembly 244 may include an interconnect 258 that forms separate fluidic connections between coaxial channels 254, 256 of tip 242 and respective channels of channel network 100 (see FIG. 5), namely, a dispense channel 260 and a loading channel 130. Channels 260 and 130 may be defined by respective tubing members 262, 264. An end of each tubing member may be received in bores of interconnect 258 and secured to the interconnect with fittings 266. An upper end of tip 242 also may be received in a bore of interconnect 258 and secured in position.

The two separate fluid connections are as follows: outer channel 256 of tip 242 is in fluid communication with dispense channel 260 via interconnect cross channel 268, and inner channel 256 of the tip is in fluid communication with loading channel 130.

Figure 7:
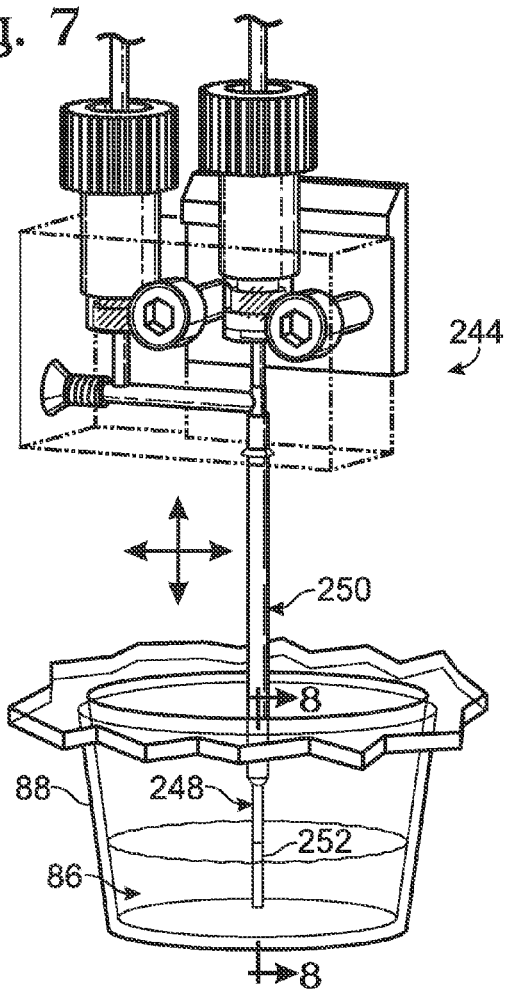
FIG. 7 is a view of the coaxial tip and interconnect of FIG. 6, with an end region of the tip extending into an emulsion held by a well of a multi-well plate, in accordance with aspects of the present disclosure.

FIG. 7 shows fluidic assembly 244 with a lower section of nose 252 of inner tube 248 immersed in emulsion 86. Outer tube 250 is not in contact with the emulsion. Accordingly, the emulsion may be picked up with the inner tube, without the emulsion contacting (or contaminating) the outer tube.

Figure 8:
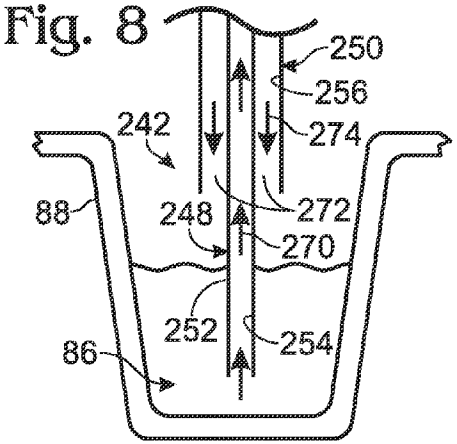
FIG. 8 is a schematic sectional view of the coaxial tip, emulsion, and well of FIG. 7, taken generally along line 8-8 of FIG. 7, as the emulsion is being picked up by the tip, in accordance with aspects of the present disclosure.

FIG. 8 schematically shows exemplary directions of fluid flow through channels 254, 256 of tip 242 as emulsion 86 is being picked up by the tip. The emulsion may be drawn into inner tube 248, as indicated by flow arrows at 270. In contrast, a carrier fluid (or dilution fluid) 272 may be dispensed from outer tube 250, as indicated by opposing flow arrows at 274. The carrier fluid may be dispensed at any suitable time relative to uptake of the emulsion. For example, the carrier fluid may be dispensed concurrently with uptake of the emulsion, may be dispensed during one or more overlapping time intervals, may be dispensed during one or more nonoverlapping time intervals (e.g., in alternation with periods of uptake), or the like.

Figure 9:
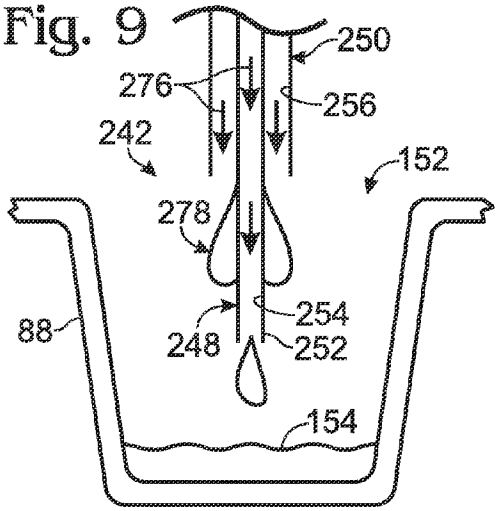
FIG. 9 is a schematic sectional view of the coaxial tip of FIG. 7, taken as in FIG. 8 but with the tip being cleaned in a wash station, in accordance with aspects of present disclosure.

FIG. 9 schematically shows exemplary directions of fluid flow through channels 254, 256 of tip 242 as the tip is being cleaned in wash station 152. Here, fluid is flowing through inner tube 248 and outer tube 250 of the tip in the same direction, as indicated by flow arrows at 276.

Fluid flowing through the inner tube is flushing any residual droplets from the tube, and fluid flowing through the outer tube is rinsing the exterior of nose 252, indicated by fluid at 278. The nose may be out of contact with any fluid in the wash station during this cleaning procedure. Alternatively, any suitable portion of the tip may be immersed in a cleaning fluid during a flushing, rinsing, or dipping operation.

FIG. 5 shows a fluidics layout that enables use of coaxial tip 242 for emulsion pickup and tip cleaning. A pair of pumps 290, 292 may function cooperatively during emulsion loading and droplet examination. Each of the pumps may be operatively connected to the same source 294 of dilution fluid 246, such as oil, held by a container 296 with a vented filter 298. A third pump, namely, a cleaning pump 300, may be operatively connected to a source of cleaning fluid 302.

Pumps 290, 292 may load emulsion 86 with valve 174 in configuration B and waste channel 184 closed. Fluid flow through the waste channel may be blocked by any suitable valve, such as a solenoid valve 304 or a suitable connection to valve 174. With a valve configuration provided collectively by valves 174 and 304, pump 290 can draw emulsion 86 into loading channel 130 via the inner tube of tip 242, through ports 1 and 2 of valve 174, and into holding channel 136. Pump 292 can dispense dilution fluid 246 for uptake by the inner tube of tip 242 in well 88 by exerting pressure from upstream channel 306, through ports 10 and 9, to effect outflow from dispense channel 260 and the outer tube of tip 242.

Pumps 290, 292 cooperate to separate droplets and drive separated droplets through examination region 92. The valve configuration of system 240 may be changed by switching valve 174 to configuration B and opening waste line 184 by opening solenoid valve 304. Pump 292 may push the emulsion from holding channel 136 through spacer 182, while pump 290 pushes dilution fluid through the spacer. Accordingly, droplets travel from holding channel 136 to queuing channel 138, and through the examination region, without passing through another valve. Since valves can disrupt droplet integrity, the innovative use of fluidics in system 240 to reduce transit through valves can improve assay performance. In any event, the combined streams produced by positive pressure from pumps 290, 292 may carry separated droplets through examination channel 150, waste channel 184, and to waste receptacle 116.

Loading channel 130, dispense channel 260, and tip 242 may be cleaned after emulsion loading and/or droplet examination. The tip may be moved to wash station 152 before cleaning. Cleaning may be performed with dilution fluid 246 and/or cleaning fluid 302. For example, channels 130, 260 and tip 242 may be cleaned only with dilution fluid, only with cleaning fluid, or with a combination of dilution fluid and cleaning fluid, either sequentially, in alternation, or the like. Cleaning with dilution fluid 246 may be achieved using the same valve configuration as described above for loading the emulsion into loading channel 136. In particular, valve 174 may be placed in configuration B, solenoid valve 304 closed, and dilution fluid pushed through channels 130, 260 and inner and outer channels 254, 256 of the tip (e.g., see FIG. 9) in response to positive pressure applied by pumps 290, 292. In contrast, cleaning with cleaning fluid 302 may be achieved by placing valve 174 in configuration A and applying positive pressure on cleaning channels 308, 310 with cleaning pump 300. Channels 308, 310 connect to channels 130, 260 via ports 2 and 3, and ports 8 and 9, respectively. As a result, positive pressure applied by cleaning pump 300 is transferred to channels 130, 260, which drives cleaning fluid out of both channels 254, 256 of the tip (e.g., see FIG. 9), once channels 130, 260 have been flushed of oil or other dilution fluid.

Waste fluid collected in wash station 152 may be driven to waste receptacle 116 through an emptying line 312 by a pump, such as a peristaltic pump 314, which is shown schematically in FIG. 5. The peristaltic pump may operate continuously or intermittently to empty the wash station.

Cleaning fluid 302 may have a different chemical composition than dilution fluid 246. For example, the cleaning fluid may be more hydrophilic and/or polar than the dilution fluid. Use of a more hydrophilic/polar cleaning fluid may be more efficient at removing residual droplets, because the dispersed phase of the droplets may be more soluble in the cleaning fluid than the dilution fluid. The cleaning fluid also may be at least partially soluble in the dilution fluid, and vice versa, to allow the cleaning fluid to remove the dilution fluid from the channels, and vice versa. Exemplary cleaning fluids may include organic solvents, such as alcohols and ketones, among others, which may be of low molecular weight (e.g., with a molecular weight of less than about 500 daltons). Suitable alcohols may include ethanol and isopropanol, and suitable ketones may include acetone, among others. The cleaning fluid may or may not include water. Exemplary concentrations of water in the cleaning fluid include about 0 to 50%, 5 to 40%, or 10 to 30%, among others. Use of a cleaning fluid may reduce the amount of dilution fluid needed to clean loading and dispense channels 130, 260 and tip 242.

For example, in some embodiments, oil consumption may be reduced from about 1.75 mL per well to about 0.4 mL per well, with a corresponding savings in cost. Alternatively, or in addition, use of a cleaning fluid may reduce or virtually eliminate carryover (e.g., contamination with residual droplets) in subsequent examinations of other emulsions. The cleaning fluid may remove contamination found in the coaxial tip and/or dissolve clogs in the wash station. Reductions in oil consumption and contamination may increase sample processing efficiency, for example, complete cleaning of the pickup tip may reduce contamination from two-phase pickup, increasing the number of droplets that may be picked up and processed, and throughput may be increased by flushing the tip with a third pump during droplet separation and examination. Some suitable cleaning fluids, such as 70% ethanol, are standardly stocked and available in laboratories such as biology laboratories that would perform droplet assays. Some cleaning fluids, again such as 70% ethanol, could mitigate microbial growth in output lines and waste reservoirs and could separate dilution oil from any additional anti-mold agents that might be necessary or desirable for preventing growth. Ethanol may be miscible in various fluorocarbon oils, such as HFE, which could reduce or eliminate two-phase problems and water-soluble contamination (which HFE alone might not).

Loading channel 136, queuing channel 138, and examination channel 150 also may be cleaned after examination of a set of droplets from an emulsion. The cleaning may be performed by placing valve 174 in configuration A, opening solenoid valve 304, and driving fluid from loading channel 136, through examination channel 150, to waste channel 184, and waste receptacle 116, by application of positive pressure on upstream channel 306 with pump 292.

Example 3

Exemplary Procedures for Using Droplet Transport Systems

This example describes exemplary procedures and other considerations for using droplet transport systems, such as the system of Example 2, among others. These procedures may include the following classes of operations: (A) pre-plate processing, (B) well processing, (C) post-plate processing, and (D) special operations.

A. Pre-Plate Processing

Before the first well (or container) is processed, the following operations may be executed:

Detector Start.

The performance of the detector may be sensitive to temperature. For example, the color spectra of the detector LEDs may change with temperature. The LEDs emit heat during use and may require a warm-up period to achieve a stable operating temperature. The LEDs can be turned on in advance of well processing to assure that the temperature and color spectra are stable before processing wells.

Pump Initialization.

Since the system can be in an unknown state at startup, initializing the pumps puts the system in a known state. The pumps (e.g., sample pump, oil or dilution pump, waste or peristaltic pump, etc.) can be initialized to a home position. The pumps can be initialized to be filled with a specified volume of oil. The pumps may have valves integrated into a single package; the valves on the pumps can be initialized to a known position.

Examination Region and Spacer Flush.

The examination region tubing and spacer may be flushed with a volume of oil to remove residual sample or debris from an earlier use. To flush the examination region tubing and spacer, sample and oil (e.g., dilution) pumps can each be filled with a volume of oil from an oil reservoir. After filling the pumps, a detector exhaust (or solenoid) valve can be configured to an open position and the multi-port valve can be configured to connect the sample pump to the spacer. Then, the sample and oil pumps can discharge oil to flush the examination region tubing and spacer to waste. The examination region tubing and spacer may be flushed multiple times.

Sample Pickup (Coaxial) Tip Flush and Rinse.

The sample pickup tip may be flushed (internally washed) and rinsed (externally washed) with a volume of oil to remove residual sample or debris from an earlier use. To flush and rinse the sample pickup tip, the sample and oil pumps can each be filled with a volume of oil from the oil reservoir. After filling the pumps, the sample pickup tip can be positioned over a wash station (or waste well). The detector exhaust valve can be configured to a closed position and the multi-port valve can be configured to connect the sample pump to the outer channel of the pickup coaxial tube, and the oil pump to the sample pickup tip. Then, the sample pump can rinse the sample pickup tip by discharging oil through the outer channel of the pickup coaxial tube, and the oil pump can flush the sample pickup tip by discharging oil through the sample pickup tip. The oil from flushing and rinsing flows into the wash station. A waste (e.g., peristaltic) pump may transport oil from the wash station to a waste reservoir to prevent overflowing the wash station. The sample pickup tip may be flushed and rinsed multiple times.

B. Well Processing

During processing of a sample (e.g., droplets) in a sample well (e.g., a well of a multiwell plate), the following operations may be executed:

Pickup Tip Pre-Wetting.

The external surface of the sample pickup tip may be pre-wetted with oil. The sample pump may be filled with a volume of oil from the oil reservoir. The multi-port valve may be configured to connect the sample pump to the outer channel of the pickup coaxial tube and the oil pump to the sample pickup tip. The sample pickup tip may be positioned over the wash station. Then, the sample pump may discharge oil into the wash station. A waste pump may transport oil from the wash station to the waste reservoir to prevent overflowing the wash station. The sample pickup tip may be pre-wetted multiple times. Similarly, the oil pump may be used for pre-wetting the internal surface of the sample pickup tip.

Sample Oil Addition.

Oil may be added to a sample. The sample pump may be filled with a volume of oil from the oil reservoir. The multi-port valve may be configured to connect the sample pump to the outer channel of the pickup coaxial tube. The sample pickup tip may be positioned over a sample well containing a sample. Then, the sample pump may discharge oil through the outer channel of the pickup coaxial tube into the sample well. Similarly, the oil pump may be used to add oil to the sample well through the sample pickup tip.

Transfer of Sample from the Sample Well to a Holding Channel.

Sample may be transferred from a sample well to a holding channel (e.g., sample holding loop). Before transferring the sample, either the sample pump or the oil pump or both may be preloaded with a volume of oil. The volumes preloaded into the pumps may be any volume that facilitates sample processing. The volumes preloaded into the sample pump and oil pump may be 5 μL and 5 μL, respectively, among others.

The sample pickup tip may enter a sample well where it is in fluid communication with the sample. The sample pickup tip may be positioned to a depth in the sample well such that pickup of the sample is effective. The sample pickup tip may be positioned a predetermined height (e.g., 500 μm) above the bottom of the sample well.

The detector exhaust valve may be configured to its closed position and the multi-port valve may be configured to connect the sample pump to the outer channel of the pickup coaxial tube and the spacer to the sample pickup tip. The oil pump may aspirate a volume, which causes flow from the sample well through the sample pickup tip, sample pickup tubing, multi-port valve, holding channel, spacer, oil tubing (e.g., oil splitting tubing, oil splitting tee, etc.) into the oil pump. The rate of aspiration may be any rate that is effective for sample pickup. The sample pickup rate may be 360 μL/min. The volume aspirated by the oil pump may be any volume that is effective for sample pickup. The volume aspirated may be a volume sufficient to move the sample from the sample well, through the intermediate tubing, and into the holding channel. The volume aspirated may be 138 μL.

During aspiration of the sample by the oil pump, the sample pump may add additional oil to the sample well. The oil may be used to increase the yield (amount of sample recovered from the sample well). The extra oil may be added at any rate and at any volume that is effective for sample pickup. Additional oil may be added all at once or as a series of additions. Each addition may independently be at any desired rate and volume.

During aspiration of the sample by the oil pump, air may be allowed to enter the sample pickup tip. Air trailing the sample may increase yield by decreasing the amount of sample that adheres to the walls of the tubing. The air may be introduced into the sample pickup tip by aspirating a volume greater than the volume of liquid in the well. The air also may be introduced into the sample pickup tip by positioning the sample pickup tip such that it is in fluid communication with air instead of sample.

The sample may be aspirated all at once or it may be aspirated as a series of aspiration steps. There may be a time delay between the aspiration steps. The aspiration steps may be interleaved with oil addition steps from the sample pump and/or air aspiration steps. The sequence of sample aspiration steps, air aspiration steps, and oil addition steps may be configured to increase the amount of sample recovered from the sample well.

Oil added during sample pickup may be transferred directly from the outer channel of the pickup coaxial tube to the sample pickup tip without entering the sample well. The added oil may be allowed to flow in sheath flow along the outside of the sample pickup tip. Once this oil reached the end of the sample pickup tip it may be entrained into the sample pickup tip without entering the sample well.

Sample Detection.

Sample may be transferred from the holding channel through the spacer and through a detector where an analyte in the sample is detected. The multi-port valve may be configured to connect the sample pump to the holding channel. The detector exhaust valve may be opened to connect the detector exhaust to waste.

The sample pump and oil pump may each be filled with a volume of oil to effectively transport the sample from the holding channel through the spacer, through the detector, and to waste. The oil pump and sample pump may simultaneously discharge, causing flow of sample out of the holding channel and into the spacer, and oil into the spacer. The oil and sample may mix together in the spacer. The mixing of sample and oil in the spacer may increase the spacing between droplets in the sample.

Spacer and Examination Region Flushing.

After processing a sample, the spacer and examination region tubing may be flushed. See previous description.

Sample Pickup Tip Rinsing and Flushing.

After processing a sample, the sample pickup tip may be rinsed and flushed. See previous description.

C. Post-Plate Processing

After processing a series of wells, the following operations may be executed:

Spacer and Examination Region Flushing.

After processing a sample, the spacer and examination region tubing may be flushed. See previous description.

Sample Pickup Tip Rinsing and Flushing.

After processing a sample, the sample pickup tip may be rinsed and flushed. See previous description.

D. Other Operations

Other operations that may be executed as needed:

Fluidics Priming.

The fluidics system may be primed to remove air bubbles that are in the system. Priming is achieved by alternately filling the pumps with oil from the oil reservoir, then dispensing the oil through the circuit. The priming can be performed using any volume and flow rate that is effective in removing air from the system. Priming can be performed as a single operation or as a series of priming operations.

Clog Removal.

The fluidics system may undergo clog removal operations for removal of clogs (e.g., caused by droplet aggregates, foreign matter, etc.). Clog removal operations can include any combination of starting and stopping pump flows and toggling of valves that is effective for removal of clogs.

Example 4

Additional Exemplary Transport Systems with a Coaxial Tip

Figure 10:
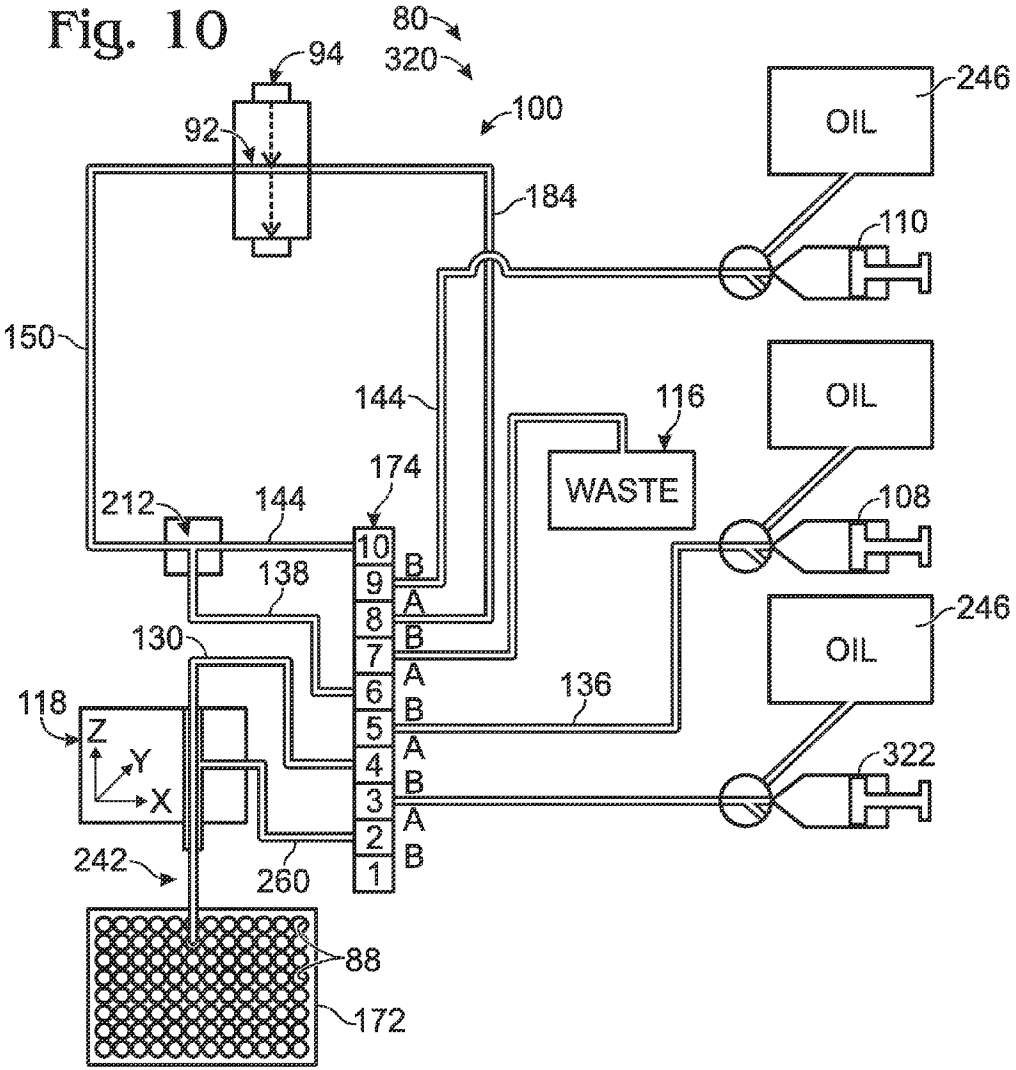
FIG. 10 is a schematic view of a fourth exemplary embodiment of the droplet transport system of FIG. 2, with the system including a coaxial tip and three pumps, in accordance with aspects of present disclosure.
Figure 11:
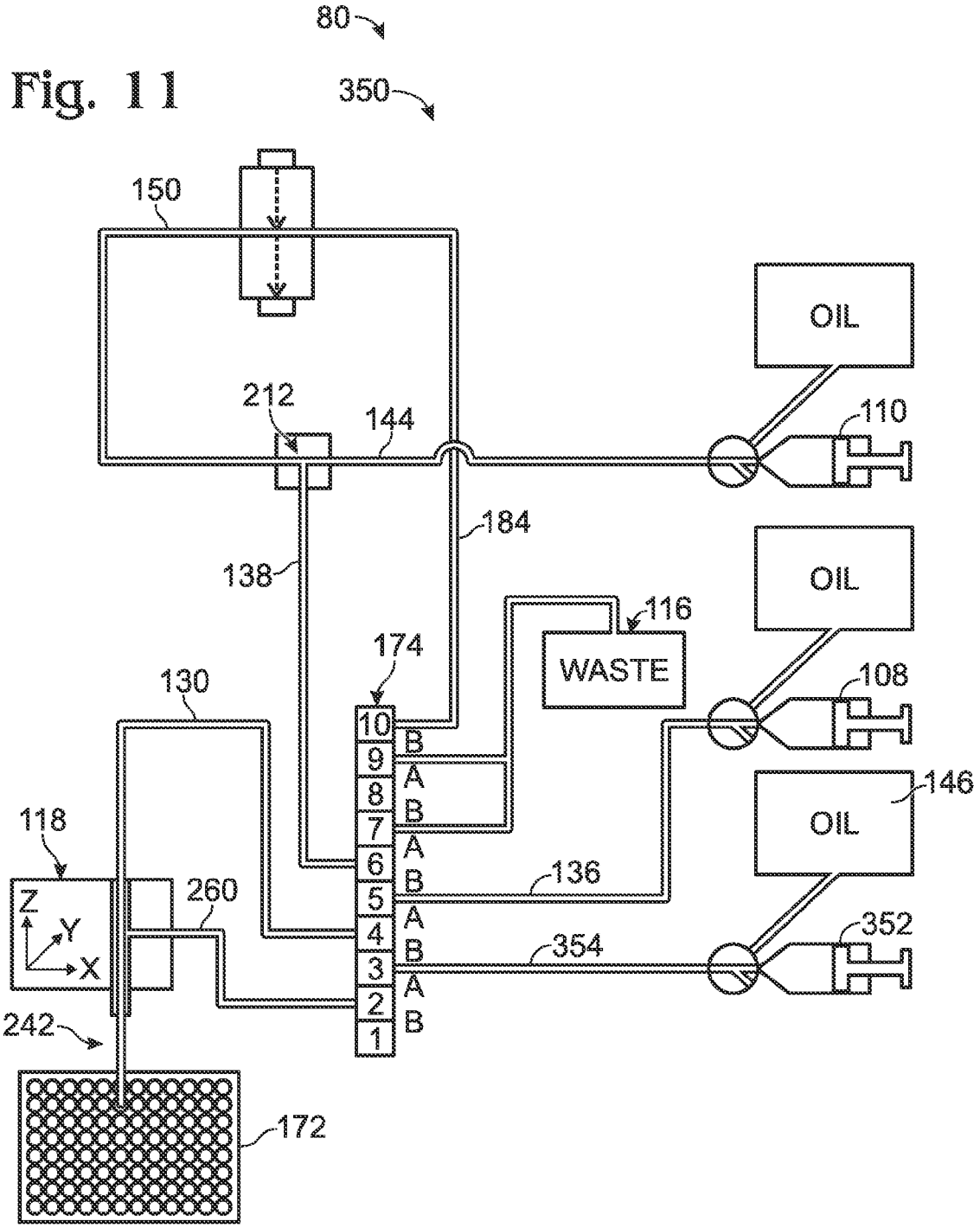
FIG. 11 is a schematic view of a fifth exemplary embodiment of the droplet transport system of FIG. 2, with the system including a coaxial tip and three pumps, in accordance with aspects of the present disclosure.

This example describes additional exemplary droplet transport systems with a coaxial tip; see FIGS. 10 and 11. These systems may include any combination of the components and features disclosed herein for other transport systems.

FIG. 10 shows an exemplary droplet transport system 320 including coaxial tip 242 of system 240. Transport system 320 may include three pumps and a 10-port valve. With this layout, all of the following functions can be integrated: droplet pickup, rinsing the pickup tip and container during pickup, flushing the examination region in parallel with pickup tip operation, parallel preparation/cleaning of the pickup tip during droplet introduction to the examination region, flow focusing/droplet separation, backflushing of the examination region of the circuit, or any combination thereof, among others.

Transport system 320 may include a dispense pump 322 that is used with sample pump 108 to load an emulsion into holding channel 136. Valve 174 is placed in configuration A. The emulsion is drawn into loading channel 130 by application of a negative pressure with sample pump 108. A dilution fluid 246 is dispensed to well 88 by application of a positive pressure with dispense pump 322, such that at least a portion of the dilution fluid is taken up with the emulsion into channels 130, 136. The dilution fluid may improve the efficiency of emulsion loading.

Droplets of the loaded emulsion may be separated and examined with valve 174 in configuration B. Sample pump 108 may apply a positive pressure to drive emulsion from holding channel 136 to queuing channel 138, through spacer 212, through examination region 92, and to waste channel 184 and waste receptacle 116. Dilution pump 110 may drive dilution fluid 246 through dilution channel 144 as droplets are traveling through the spacer, to provide droplet separation.

Channels 130 and 260, among others, and tip 242, may be cleaned by operation of sample pump 108 and dispense pump 322. For example, both pumps may apply positive pressure with valve 174 in configuration B, to clean channels 130, 260 and tip 242.

FIG. 11 shows yet another exemplary droplet transport system 350 including coaxial tip 242 of system 240. The system may include sample pump 108, dilution pump 110, and a dispense pump 352. Sample pump 108 and dispense pump 352 may be used cooperatively, with valve 174 in configuration A, to load an emulsion into holding channel 136. In particular, sample pump 108 may apply a negative pressure to the inner channel of tip 242 via channels 130, 136, to draw the emulsion into loading channel 136. As explained above for transport system 240 (e.g., see FIG. 8), dispense pump 352 may dispense dilution fluid 146 by applying a positive pressure to dispense channel 260, to improve the efficiency of emulsion loading.

Valve 174 may be placed in configuration B to permit sample pump 108 to apply a positive pressure to holding channel 136, such that the emulsion travels to queuing channel 138. Pumps 108, 110 may apply a positive pressure to queuing channel 138 and dilution channel 144, respectively, to drive the emulsion and dilution fluid through spacer 212 and examination channel 150, to waste channel 184, through ports 9 and 10 of valve 174, and finally to waste receptacle 116.

Channels and the tip may be cleaned as follows. Sample pump 108 and dispense pump 352 may be utilized to clean channels 130, 260 and tip 242. The pumps each may apply a positive pressure to loading channel 136 and cleaning channel 354 with valve 174 in configuration A, to flush channels 130, 260, and flush and rinse the inner tube of tip 242, in the manner described above for system 240 (e.g., see FIG. 9). Channels 136, 138, and 150 may be cleaned by placing valve 174 in configuration B and pushing fluid from these channels to waste line 184 and waste receptacle 116 by application of positive pressure with pump 108.

Example 5

Exemplary Transport System with Droplet Injection

Figure 12:
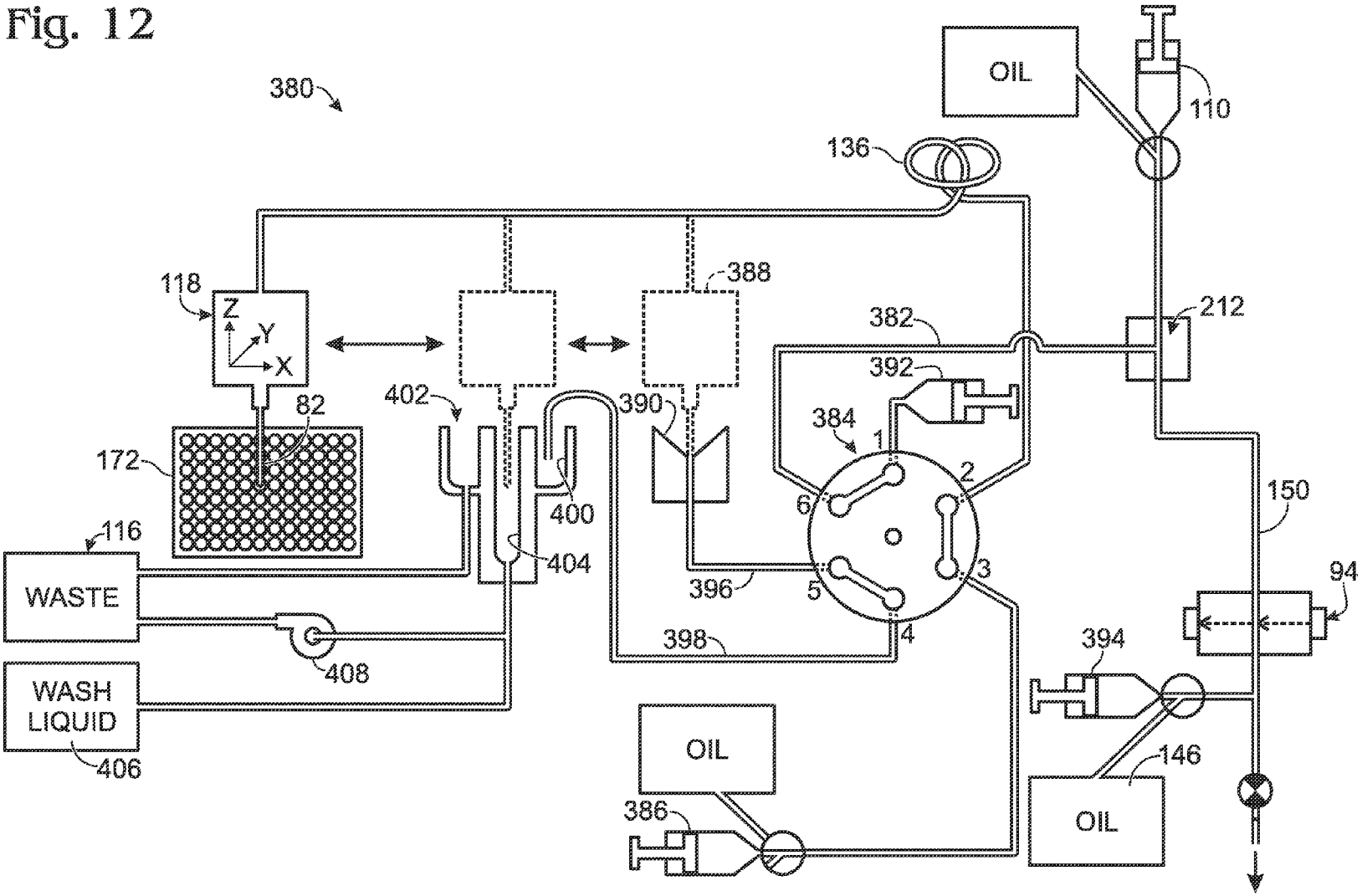
FIG. 12 is a schematic view of a sixth exemplary embodiment of the droplet transport system of FIG. 2, with the system providing droplet uptake and dispensing in opposing directions through a tip of the system, in accordance with aspects of the present disclosure.

This example describes an exemplary droplet transport system 380 with injection of droplets from tip 82 into an injection port; see FIG. 12.

System 380 may pick up an emulsion with tip 82 from plate 172 and then dispense the emulsion back out of the tip into a queuing channel 382. The emulsion may be driven from the queuing channel into spacer 212 for droplet separation using dilution fluid 146 driven by dilution pump 110, and on to detection channel 150 for detection with detection unit 94.

The channel network of system 380 may be equipped with a multi-port valve 384, which is similar in design to valve 174 (e.g., see FIG. 3), but has fewer ports, namely, ports 1 to 6. Valve 384 has two configurations. In configuration A, the following ports are connected to one another: ports 1 and 2, 3 and 4, and 5 and 6. In configuration B, the following ports are connected to one another 2 and 3, 4 and 5, and 6 and 1. The valve is shown in configuration B in FIG. 12.

An emulsion may be transferred from plate 172 to queuing channel 382 as follows. The emulsion may be drawn into holding channel 136 by applying a negative pressure with a loading pump 386, with valve 384 in configuration B (as shown). Drive assembly 118 then may align tip 82, indicated in phantom at 388, with a seat 390 that provides an injection port, and lower the tip into the fluid-tight engagement with the seat. Valve 384 next may be placed into configuration A, which connects ports 5 and 6, and ports 1 and 2. An injection pump 392 then may apply a positive pressure to holding channel 136, to drive the emulsion from the loading channel, through seat 390, and into queuing channel 382. Additional pressure from the injection pump coupled with positive pressure from dilution pump 110 provides emulsion dilution, droplet separation, and detection.

The fluid lines and tip may be cleaned as follows. A back-flush pump 394 may drive dilution fluid 146 in reverse through channels 150 and 382 to flush the channels. Loading pump 386 may flush holding channel 136 and tip 82 by applying positive pressure while the tip is still engaged with seat 390. Fluid flows out of the tip, into waste lines 396, 398, and into a lateral basin 400 of a wash station 402. The tip then may be disconnected from seat 390 and repositioned in a central basin 404 of the wash station. A wash liquid 406 may be driven into basin 404, to clean the outside of the tip by immersion in the wash liquid. One or more pumps 408 may drive contaminated wash solution and/or fluid flushed from the lines into waste receptacle 116.

Example 6

Further Aspects of Droplet Transport Systems

Droplets may be picked up with a fluid-transfer device from one of many vial formats: individual vials, well strips, 96-well plates, etc. The vial format can be temperature controlled and/or sealed (e.g., with seal that can be pierced with the tip). In general, either a fluid-transfer tip or the vial format (or both) can be moved via an XYZ stage to provide access to all wells, special wash receptacles, sanitation or cleaning stations, etc. Pickup of fluid and fluid movement within the fluid-transfer device can be driven by any suitable drive mechanism, such as a pressure source (e.g., a positive displacement pump), etc. The drive mechanism drives fluid movement of an emulsion from a vial into a pickup tip. In some cases, first and second fluidics connection can be made to the vial. The first fluidics connection may be used to pick up droplets with negative pressure from a first pressure source, while the second fluidic connection allows rinsing of the pickup tip and vial, optionally while droplets are being picked up with the first pressure source, with positive pressure from a second pressure source. In some case, the second fluidics connection can be used to pressurize the vial with positive pressure, which drives the droplets into the channel network. In some embodiments, the droplets may be pulled with a pump through a valve and into a holding channel, and then driven from the holding channel to a spacer and/or an examination region with the same pump (by reverse the action of the pump) or a different pump. In each system, one or more sensors and/or detectors can be introduced for accurate fluid metering and positioning.

In some embodiments, droplets may be drawn into a tip (e.g., a needle) and then may remain in the tip while the tip is moved to an injection port (needle seat) for introduction of the droplets from the tip directly into the detector.

Each transport system may include a droplet separator, which may be a flow focuser, between the pickup tip and the detector, which can be used to increase the spacing between droplets or to align droplets in the flow stream. In general, this requires introduction of another pressure source.

Each transport system may allow for the introduction of a fluid path to backflush the fluidics lines, such as to remove clogs from small diameter tubing. In general, this requires introduction of another pressure source and may impose additional valving requirements.

Example 7

Selected Embodiments

This example describes additional aspects and features of droplet transport systems for detection, presented without limitation as a series of numbered paragraphs. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

1. A method of transporting droplets for detection, comprising: (A) disposing a tip in contact with an emulsion including droplets, the tip including an outer channel and an inner channel each disposed in fluid communication with a channel network; (B) loading droplets from the emulsion into the channel network via the inner channel; and (C) moving loaded droplets to an examination region of the channel network.

2. The method of paragraph 1, wherein the outer channel and the inner channel are defined by an outer tube and an inner tube, respectively, and wherein the step of disposing includes a step of creating contact between the emulsion and the inner tube and not between the emulsion and the outer tube.

3. The method of paragraph 1, wherein the tip includes a nose defining a region of the inner channel that projects below the outer channel when the tip is disposed in contact with the emulsion.

4. The method of paragraph 1, wherein the inner channel and the outer channel are substantially coaxial with each other.

5. The method of paragraph 1, further comprising a step of dispensing fluid from the outer channel and into contact with at least a portion of the emulsion.

6. The method of paragraph 5, wherein the step of loading includes a step of introducing, into the channel network via the inner channel, at least a portion of the fluid dispensed from the outer channel.

7. The method of paragraph 1, wherein the emulsion is held by a container, and wherein the step of disposing includes a step of disposing at least a lower region of the inner channel in the container.

8. The method of paragraph 7, wherein the container is a well.

9. The method of paragraph 8, wherein the well is included in a multi-well plate.

10. The method of paragraph 1, wherein the step of loading includes a step of applying a negative pressure to the inner channel from the channel network.

11. The method of paragraph 10, wherein the negative pressure is created with a syringe pump.

12. The method of paragraph 1, further comprising a step of cleaning the tip after the step of loading by dispensing fluid from the inner channel and the outer channel.

13. The method of paragraph 12, wherein the step of cleaning is performed at least in part during performance of the step of moving loaded droplets.

14. The method of paragraph 12, wherein the step of loading is performed with the tip disposed in a container, and wherein the step of cleaning is performed after moving the tip from the container to a wash station.

15. The method of paragraph 1, wherein the step of disposing includes a step of moving the emulsion while the tip is held stationary.

16. The method of paragraph 1, further comprising a step of detecting light received from the examination region as droplets travel through the examination region.

17. The method of paragraph 1, further comprising a step of collecting data related to droplets that have been examined in the examination region.

18. A system for transporting droplets for detection, comprising: (A) a tip configured to contact an emulsion and including an outer channel and an inner channel; (B) a channel network including an examination region; (C) one or more pressure sources capable of applying pressure independently to the outer channel and the inner channel via the channel network and configured to load droplets of the emulsion into the channel network via the inner channel and to drive loaded droplets to the examination region; and (D) a detector configured to detect light from fluid flowing through the examination region.

19. The system of paragraph 18, wherein the inner channel is configured to project below the outer channel when droplets of the emulsion are loaded into the channel network.

20. The system of paragraph 18, wherein the tip includes a nose defining a region of the inner channel that projects below the outer channel when the tip is disposed in contact with the emulsion.

21. The system of paragraph 18, wherein the outer channel and the inner channel are defined by respective outer and inner tubes that are substantially coaxial with each other.

22. The system of paragraph 18, wherein the outer channel and the inner channel are configured to be operatively connected to respective different pressure sources when the droplets of the emulsion are loaded into the channel network.

23. The system of paragraph 22, wherein the pressure source operatively connected to the outer channel when the droplets are loaded is configured to dispense fluid from the outer channel and into contact with an inner tube defining the inner channel.

24. The system of paragraph 18, wherein the pressure sources include a first pressure source configured to apply a negative pressure to the inner channel to draw droplets into the inner channel and also include a second pressure source configured to apply a positive pressure to the outer channel to dispense fluid from the outer channel.

25. The system of paragraph 18, wherein each of the pressure sources is capable of applying positive pressure and negative pressure to the channel network.

26. The system of paragraph 25, wherein at least one of the pressure sources is a syringe pump.

27. The system of paragraph 18, wherein each of the pressure sources is operatively connected to a source of fluid.

28. The system of paragraph 18, further comprising a controller configured to determine a characteristic of droplets of the emulsion based on a signal created by the detector that is representative of the light detected.

29. The system of paragraph 18, wherein one or more of the pressure sources is configured to clean the tip by applying a positive pressure to the inner channel and the outer channel such that each channel dispenses fluid.

30. The system of paragraph 29, further comprising a drive assembly operatively connected to the tip and configured to move the tip to a wash station after loading droplets and before dispensing fluid from the inner channel and the outer channel.

31. A method of transporting droplets for detection, comprising: (A) disposing a tip in contact with an emulsion including aqueous droplets disposed in a continuous phase; (B) loading droplets from the emulsion into a channel network via by the tip; (C) moving loaded droplets to an examination region of the channel network; (D) driving through the tip a cleaning fluid that is substantially more hydrophilic than the continuous phase; and (E) repeating the steps of disposing, loading, and moving with another emulsion.

32. The method of paragraph 31, further comprising a step of detecting light from the examination region as droplets flow through the examination region.

33. The method of paragraph 31, wherein the continuous phase is an oil phase comprising an oil.

34. The method of paragraph 33, wherein the continuous phase comprises a surfactant.

35. The method of paragraph 33, wherein the oil includes a fluorinated oil.

36. The method of paragraph 35, wherein the continuous phase comprises a fluorinated surfactant.

37. The method of paragraph 31, further comprising a step of thermally cycling the aqueous droplets.

38. The method of paragraph 31, further comprising a step of increasing an average distance between droplets as such droplets are moved to the examination region.

39. The method of paragraph 31, wherein the step of increasing an average distance includes a step of moving droplets through a confluence region of the channel network.

40. The method of paragraph 31, wherein the step of driving moves the cleaning fluid through a channel defined by the tip, further comprising a step of flushing the channel defined by the tip with oil after the step of driving and before the step of repeating.

41. The method of paragraph 31, wherein the cleaning fluid is miscible with water.

42. The method of paragraph 31, wherein the cleaning fluid includes an organic solvent with a molecular weight of less than 500.

43. The method of paragraph 31, where the cleaning fluid includes an alcohol or a ketone.

44. The method of paragraph 43, wherein the cleaning fluid includes ethanol.

45. The method of paragraph 44, wherein the cleaning fluid is at least predominantly ethanol.

46. The method of paragraph 31, wherein the cleaning fluid includes water.

47. The method of paragraph 31, wherein the step of driving includes a step of dispensing the cleaning fluid from the tip.

48. The method of paragraph 31, wherein the cleaning fluid is the same as the continuous phase fluid.

49. The method of paragraph 48, wherein the cleaning fluid comprises a fluorinated surfactant.

50. A system for transporting droplets for detection, comprising: (A) a tip; (B) a channel network including an examination region; (C) one or more pressure sources configured to load droplets of an emulsion into the channel network via the tip and to drive loaded droplets to the examination region; (D) a first fluid source and a second fluid source each operatively connected to at least one of the pressure sources, the first fluid source providing a cleaning fluid that is substantially more hydrophilic than a fluid provided by the second fluid source; and (E) a detector operatively connected to the examination region.

51. The system of paragraph 50, further comprising a controller configured to process droplet data based on a signal received from the detector.

52. A method of transporting droplets for detection, comprising: (A) disposing a tip in contact with an emulsion including droplets; (B) loading droplets from the emulsion via the tip into a flow path that is open between the loaded droplets and an examination region and closed downstream of the examination region; (C) opening the flow path downstream of the examination region; and (D) driving droplets through the examination region.

53. The method of paragraph 52, wherein the step of loading is performed with a first pressure source and disposes the droplets upstream of a confluence region, and wherein the step of driving droplets includes a step of driving the droplets to the confluence region with a second pressure source.

54. A method of droplet transport for detection, comprising: (A) disposing a tip in contact with an emulsion including droplets; (B) loading droplets from the emulsion via the tip, with pressure from a first pressure source, and into a holding channel that is upstream of a confluence region and an examination region; (C) driving droplets to the confluence region with pressure from a second pressure source; and (D) driving the droplets through the examination region with pressure from both the first and second pressure sources.

55. A method of transporting droplets for detection, comprising: (A) disposing a tip in contact with an emulsion including droplets; (B) driving fluid on a first path through a valve in a first configuration, to load droplets from the emulsion into a channel network via by the tip; (C) placing the valve in a second configuration; (D) moving droplets through an examination region of the channel network by driving fluid on at least a second path and a third path through the valve in the second configuration; and (E) detecting light received from the examination region as droplets move through the examination region.

56. The method of paragraph 55, wherein the valve is a multi-port valve including at least four ports, wherein individual pairs of the ports are in fluid communication in the first configuration, wherein different individual pairs of the ports are in fluid communication in the second configuration, and wherein each path through the valve is formed by a pair of the ports that are in fluid communication.

57. The method of paragraph 55, wherein the droplets the emulsion follows a flow path from the tip to the examination region without being driven in a reverse direction on the flow path.

58. The method of paragraph 55, wherein the first configuration and second configuration collectively provide at least four different flow paths of the channel network through the valve.

59. The method of paragraph 58, further comprising a step of driving fluid on a fourth path through the valve after the step of driving fluid on a first path and the step of moving.

60. The method of paragraph 59, wherein the step of driving fluid on a fourth path dispenses fluid from the tip.

61. The method of paragraph 60, further comprising a step of driving fluid on a fifth path that dispenses fluid from the tip.

62. The method of paragraph 61, wherein the steps of driving fluid on a fourth path and on a fifth path are driven by pressure from a same pressure source.

63. The method of paragraph 59, wherein the channel network includes a confluence region at which two or more fluid streams meet, wherein the step of moving includes a step of driving droplets in a forward direction through the confluence region, and wherein the step of driving fluid on a fourth path includes a step of driving fluid in a reverse direction through the confluence region.

64. A system for transporting droplets for detection, comprising: (A) a tip; (B) a channel network including a valve including a plurality of ports and having a first configuration and a second configuration, and a plurality of channels connected to ports of the valve, at least one of the channels extending along a flow path to an examination region for droplets; (C) at least two pressure sources operatively connected to the channel network; and (D) a detector operatively connected to the examination region, wherein in the first configuration at least one of the pressure sources is configured to drive fluid through a communicating pair of the ports such that droplets are loaded into the channel network via the tip, and wherein in the second configuration at least two of the pressure sources are configured to drive fluid through two separate pairs of communicating ports such that an average distance between loaded droplets is increased before such droplets travel through the examination region.

65. The system of paragraph 64, wherein only pairs of ports are in fluid communication within the valve in the first configuration and the second configuration.

66. The system of paragraph 65, wherein the pairs of ports in fluid communication within the valve in the first configuration are different from the pairs of ports in fluid communication within the valve in the second configuration.

67. The system of paragraph 66, wherein none of the pairs of ports in fluid communication within the valve in the first configuration are in fluid communication within the valve in the second configuration.

68. The system of paragraph 64, wherein the at least two pressure sources include a first pressure source, a second pressure source, and a third pressure source.

69. The system of paragraph 68, wherein the first and second pressure sources are configured to drive fluid through at least four ports in the second configuration, and wherein the third pressure source is configured to drive fluid out of the tip from the channel network.

70. The system of paragraph 64, wherein the channel network includes a waste channel that extends from the examination region to a waste receptacle.

71. The system of paragraph 70, wherein the waste channel is operatively connected to a valve configured to close a flow path from the examination region to the waste receptacle.

72. The system of paragraph 71, further comprising a wash station configured to receive fluid from the channel network, and also comprising a peristaltic pump configured to drive fluid from the wash station to the waste receptacle.

73. The system of paragraph 64, further comprising a same fluid source operatively connected to at least two of the pressure sources such that each pressure source is capable of introducing fluid from the fluid source into the channel network.

74. The system of paragraph 73, wherein the fluid source includes a dilution fluid that is immiscible with water.

75. The system of paragraph 64, further comprising a fluid source operatively connected to at least one of the pressure sources such that the at least one pressure source is capable of introducing fluid from the fluid source into the channel network, wherein the fluid from the fluid source is hydrophilic.

76. The system of paragraph 75, wherein the fluid from the fluid source is miscible with water.

77. The system of paragraph 64, further comprising a controller configured to process data related to droplets based on a signal received from the detector.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein. The following claims particularly point out certain combinations and subcombinations regarded as novel and nonobvious. Inventions embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the inventions of the present disclosure.

We claim:

1. A method of transporting droplets for detection, comprising:

providing an emulsion disposed in a container and including droplets;

creating contact between a tip and the emulsion by moving at least one of the tip and the container relative to each other, the tip being connected to an examination region and including an outer tube and an inner tube, the outer tube forming a first open end and surrounding an enclosed portion of the inner tube, the inner tube extending out of the first open end to create a projecting portion forming a second open end below the first open end;

loading droplets of the emulsion into the inner tube via the second open end;

moving loaded droplets from the inner tube to the examination region; and dispensing a first fluid onto the projecting portion of the inner tube from the first open end formed by the outer tube, and a second fluid from the second open end formed by the inner tube.

2. The method of claim 1, wherein the step of creating contact generates contact between the emulsion and the inner tube and not between the emulsion and the outer tube.

3. The method of claim 1, wherein the step of creating contact includes a step of disposing at least a lower region of the projecting portion in the container.

4. The method of claim 1, wherein the tip is connected to the examination region via a channel network, wherein the inner tube defines an inner channel, and wherein the step of loading droplets includes a step of applying a negative pressure to the inner channel from the channel network.

5. The method of claim 1, wherein the inner tube defines an inner channel, further comprising a step of dispensing cleaning fluid from the inner channel via the second open end.

6. The method of claim 1, wherein the step of creating contact includes a step of moving the emulsion while the tip is held stationary.

7. The method of claim 1, further comprising a step of detecting light from the examination region as droplets flow through the examination region.

8. The method of claim 1, further comprising a step of thermally cycling the droplets.

9. The method of claim 1, further comprising a step of increasing an average distance between droplets as the droplets are moved to the examination region.

10. The method of claim 1, wherein at least one of the first fluid and the second fluid is miscible with water.

11. The method of claim 1, wherein at least one of the first fluid and the second fluid includes an alcohol or a ketone.

12. The method of claim 1, wherein the inner tube and the outer tube are coaxial to each other.

13. The method of claim 1, wherein the step of dispensing is performed at a wash station.

14. The method of claim 1, wherein the step of dispensing is performed after the step of loading droplets.

15. The method of claim 1, wherein the droplets are disposed in a continuous phase, and wherein the first fluid is miscible with the second fluid and the continuous phase and not miscible with the droplets.

16. The method of claim 1, wherein the first fluid and the second fluid are the same as one another.

17. The method of claim 1, wherein the emulsion is a first emulsion of an array of emulsions, further comprising a step of loading droplets of a second emulsion of the array of emulsions into the inner tube via the second open end after the step of dispensing.

* * * * *